US010915060B2

(12) United States Patent
Kawai et al.

(10) Patent No.: US 10,915,060 B2
(45) Date of Patent: Feb. 9, 2021

(54) DEVELOPING DEVICE HAVING RESTRICTED MOVEMENT, PROCESS CARTRIDGE AND IMAGE FORMING APPARATUS

(71) Applicant: CANON KABUSHIKI KAISHA, Tokyo (JP)

(72) Inventors: Tachio Kawai, Tokyo (JP); Shigemi Kamoshida, Yokohama (JP); Goshi Ozaki, Yokohama (JP); Shohei Katsuya, Kawasaki (JP); Ryota Shibuya, Yokohama (JP); Daisuke Makiguchi, Izunokuni (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/720,799

(22) Filed: Dec. 19, 2019

(65) Prior Publication Data

US 2020/0201244 A1 Jun. 25, 2020

(30) Foreign Application Priority Data

Dec. 21, 2018 (JP) ..... 2018-239940

(51) Int. Cl.
*G03G 21/00* (2006.01)
*G03G 21/18* (2006.01)
*G03G 21/16* (2006.01)

(52) U.S. Cl.
CPC ..... *G03G 21/1825* (2013.01); *G03G 21/1676* (2013.01); *G03G 21/181* (2013.01);
(Continued)

(58) Field of Classification Search
CPC ..... G03G 21/181; G03G 21/1825; G03G 21/1828; G03G 2221/1807; G03G 2221/1861; G03G 21/1814; G03G 21/1676
(Continued)

(56) References Cited

U.S. PATENT DOCUMENTS 6,438,347 B2 8/2002 Nittani et al.
7,190,921 B2 3/2007 Ishii et al.
(Continued)

FOREIGN PATENT DOCUMENTS

JP H10-319819 A 12/1998
JP 2013114201 A * 6/2013
(Continued)

OTHER PUBLICATIONS

Russian Office Action dated Oct. 20, 2020, in related Russian Patent Application No. 2019141614/28 (with English translation).

*Primary Examiner* — Robert B Beatty
(74) *Attorney, Agent, or Firm* — Venable LLP

(57) ABSTRACT

A developing device includes a developing unit, swingably supported, for supplying a developer to an image bearing member, and including an inwardly extending wall portion. In an attitude during use, when against an urging force of an urging member configured to urge the developing unit in a first direction toward the image bearing member, the developing unit is moved in a second direction opposite to the first direction, the inwardly extending wall portion is contactable to a restricting member for restricting an amount of movement of the developing unit in the second direction.

28 Claims, 13 Drawing Sheets

(52) U.S. Cl.
CPC . *G03G 21/1814* (2013.01); *G03G 2221/1807* (2013.01); *G03G 2221/1861* (2013.01)

(58) Field of Classification Search
USPC ..... 399/111, 113
See application file for complete search history.

(56) References Cited

U.S. PATENT DOCUMENTS

| | | | | |
|---|---|---|---|---|
| 8,160,478 | B2 * | 4/2012 | Munetsugu ..... | G03G 21/1825 399/111 |
| 8,687,984 | B2 | 4/2014 | Kamoshida et al. | |
| 9,052,686 | B2 * | 6/2015 | Munetsugu ..... | G03G 21/1825 |
| 9,335,730 | B2 * | 5/2016 | Kusudo ..... | G03G 21/1825 |
| 9,989,892 | B2 | 6/2018 | Takeuchi et al. | |
| 10,241,438 | B2 * | 3/2019 | Abe ..... | G03G 21/1825 |
| 10,281,873 | B2 * | 5/2019 | Makiguchi ..... | G03G 21/1825 |
| 2005/0047822 | A1 * | 3/2005 | Hashimoto ..... | G03G 21/1825 399/111 |
| 2006/0245784 | A1 * | 11/2006 | Tsuzuki ..... | G03G 21/1825 399/111 |
| 2009/0297219 | A1 * | 12/2009 | Yoshino ..... | G03G 21/1828 399/114 |
| 2012/0269543 | A1 * | 10/2012 | Hashimoto ..... | G03G 21/1676 399/111 |
| 2013/0315621 | A1 * | 11/2013 | Toriyama ..... | G03G 21/185 399/111 |
| 2015/0185688 | A1 | 7/2015 | Koishi et al. | |

FOREIGN PATENT DOCUMENTS

| | | | |
|---|---|---|---|
| JP | 2015125248 | A | 7/2015 |
| KR | 10-2005-0014729 | A | 2/2005 |

* cited by examiner

DEVELOPING DEVICE HAVING RESTRICTED MOVEMENT, PROCESS CARTRIDGE AND IMAGE FORMING APPARATUS

FIELD OF THE INVENTION AND RELATED ART

The present invention relates to a developing device for supplying a developer for image formation, a process cartridge which includes the developing device and which is mountable in and dismountable from an image forming apparatus, and the image forming apparatus for forming an image by the developer supplied from the developing device.

In the image forming apparatus of an electrophotographic type, for image formation, image, an electrophotographic photosensitive member, i.e., a photosensitive drum, as an image bearing member is electrically charged uniformly. Then, the charged photosensitive drum is subjected to selective exposure to light, whereby an electrostatic latent image (electrostatic image) is formed on the photosensitive drum. Then, the electrostatic latent image formed on the photosensitive drum is developed into a toner image with toner as a developer.

Then, the toner image is transferred from the photosensitive drum onto a recording material such as a recording sheet or a plastic sheet, and then heat and pressure are applied to the toner image transferred on the recording material, so that the toner image is fixed on the recording material and thus image recording is effected.

Such an image forming apparatus requires toner supply and maintenance of various process means such as the photosensitive drum for the image formation, a charging unit for charging the photosensitive drum, and a developing unit for developing the electrostatic latent image on the photosensitive drum, in general. Further, in order to facilitate the toner supply and the maintenance, a process cartridge type in which the photosensitive drum, the charging unit, the developing unit and the like are integrally assembled into a cartridge (unit) in a frame and the cartridge is used as a process cartridge detachably mountable to an image forming apparatus main assembly has been put into practical use.

In the process cartridge type, a cartridge mounting portion is provided in an image forming apparatus main assembly, and the cartridge is mounted in the cartridge mounting portion and then the cartridge mounting portion is closed by an openable member of the image forming apparatus main assembly.

According to this process cartridge type, the maintenance of the image forming apparatus can be made by a user himself (herself), and therefore operativity can be remarkably improved, so that it is possible to provide an image forming apparatus excellent in usability and therefore, the process cartridge type has been widely used in the image forming apparatus.

Further, in recent years, in order that a user can use the image forming apparatus immediately after purchase, a type including a main assembly and a cartridge in a package during shipping such that a process cartridge is inclined in an image forming apparatus main assembly during shipping of the image forming apparatus main assembly has been employed.

In such a type including the main assembly and the cartridge in the package during the shipping, a constitution for alleviating impact exerted on the developing unit by movement during transportation of the developing unit supported swingably relative to the photosensitive drum in the image forming apparatus main assembly has been proposed by Japanese Laid-Open Patent Application (JP-A) 2015-125248. In this constitution, an openable member of the apparatus main assembly is provided with an urging portion (member), and a portion(member)-to-be-urged engaging with the urging portion with a gap therebetween in a state in which the cartridge is mounted in the apparatus main assembly is provided, so that the movement of the developing unit is restricted and thus the impact on the developing unit during the transportation is alleviated.

However, in the constitution disclosed in JP-A 2015-125248, there is a need to newly provide the urging portion (member) for restricting the movement of the developing unit during the transportation, so that the developing unit was increased in size.

SUMMARY OF THE INVENTION

The present invention has been accomplished in view of the above-described circumstances. A principal object of the present invention is to provide a developing device, a process cartridge and an image forming apparatus which are capable of suppressing impact due to movement of a developing unit during transportation without upsizing the developing unit.

According to an aspect of the present invention, there is provided a developing device comprising: a developing unit swingably supported and configured to supply a developer to an image bearing member, the developing unit including an inwardly extending wall portion, wherein in an attitude during use, when against an urging force of an urging member configured to urge the developing unit in a first direction toward the image bearing member, the developing unit is moved in a second direction opposite to the first direction, the inwardly extending wall portion is contactable to a restricting member configured to restrict an amount of movement of the developing unit in the second direction.

According to another aspect of the present invention, there is provided a developing device comprising: a developing unit comprising, a developing frame, a developer carrying member rotatably supported by the developing frame, a first shaft portion provided at one end of the developing frame with respect to a longitudinal direction of the developing frame, and a second shaft portion provided at the other end of the developing frame with respect to the longitudinal direction and disposed coaxially with the first shaft portion, wherein the developing unit is swingable about an axis of the first and second shaft portions as a swing axis, wherein the developing frame includes a projection formed by depressing a part of an outer surface thereof so as to project toward an inside of the developing frame, wherein in a cross-section perpendicular to an axial direction of a rotation shaft of the developer carrying member, as seen in a direction perpendicular to a rectilinear line connecting the swing axis of the developing unit and an axis of rotation of the developer carrying member, the developer carrying member and of the projection are disposed so as to overlap with each other.

According to another aspect of the present invention, there is provided a process cartridge including the developing device described above.

According to a further aspect of the present invention, there is provided an image forming apparatus including the developing device or the process cartridge described above.

Further features of the present invention will become apparent from the following description of exemplary embodiments with reference to the attached drawings.

Figure 7:
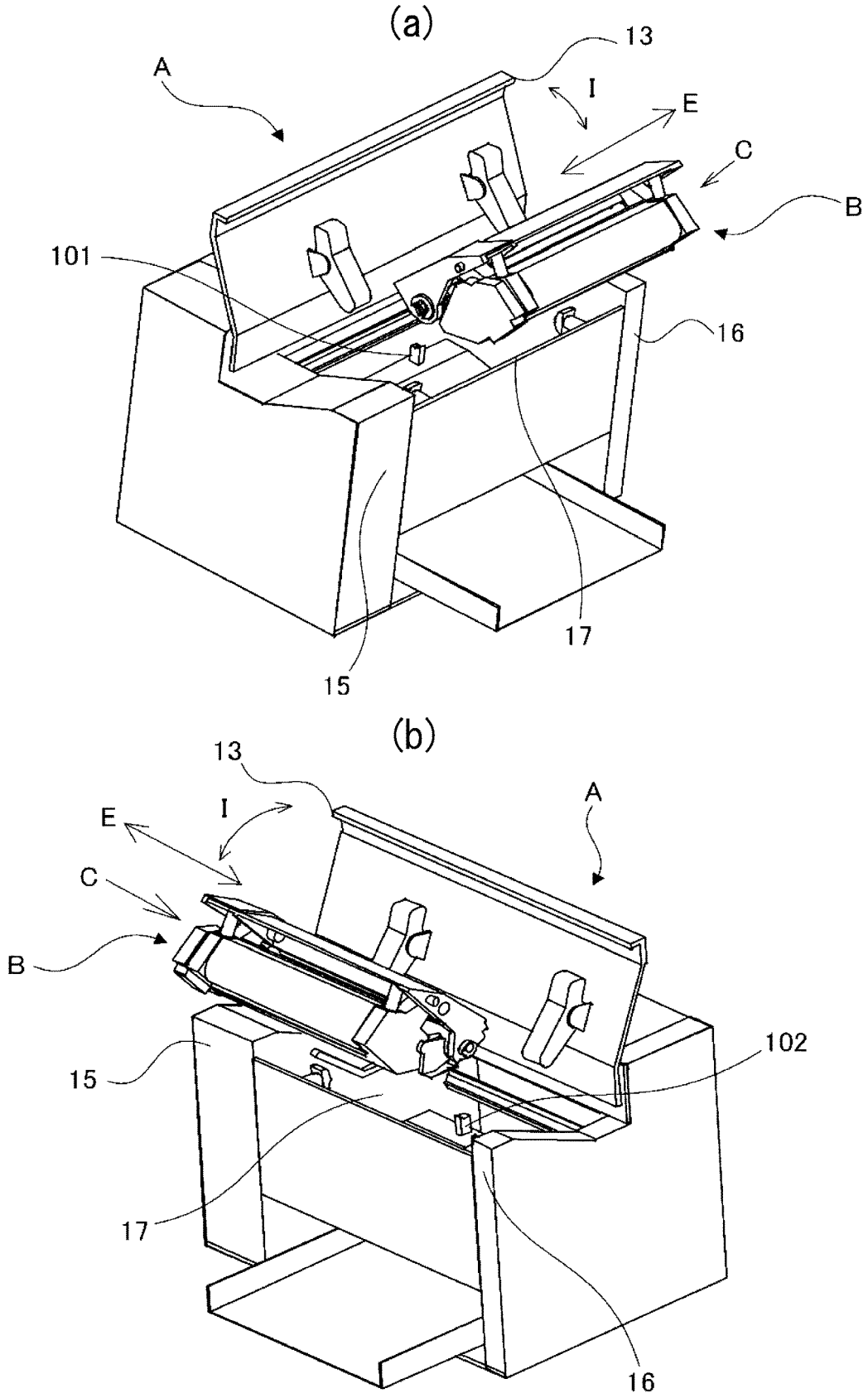

Parts (a) and (b) of FIG. 7 are perspective views of the apparatus main assembly and the cartridge according to the first embodiment when the cartridge is being mounted in and dismounted from the apparatus main assembly.

Figure 8:
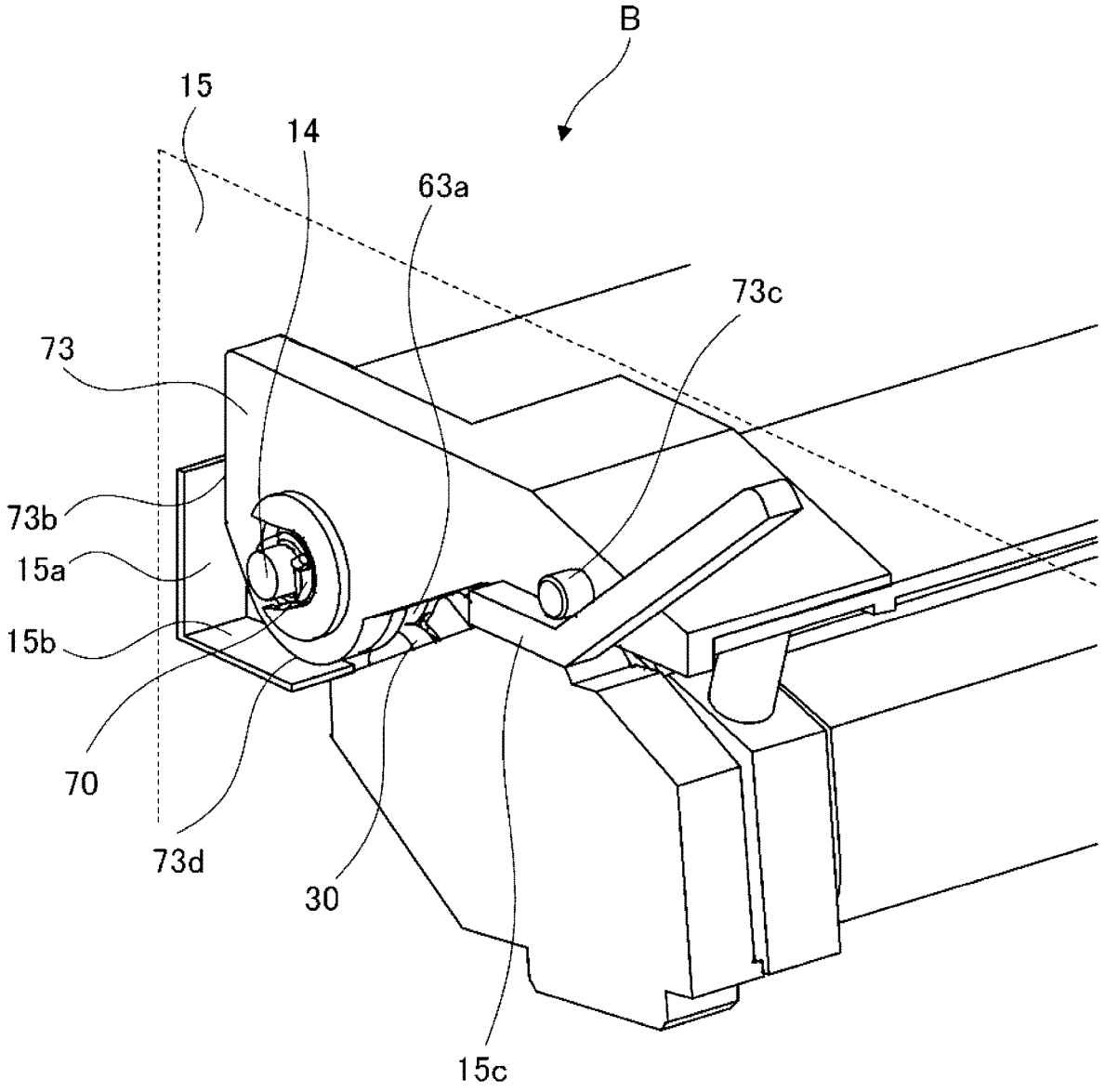

FIG. 8 is an enlarged perspective view of the cartridge according to the first embodiment and a driving side positioning portion of an apparatus main assembly A in a state in which the cartridge is mounted in the apparatus main assembly A.

Figure 9:
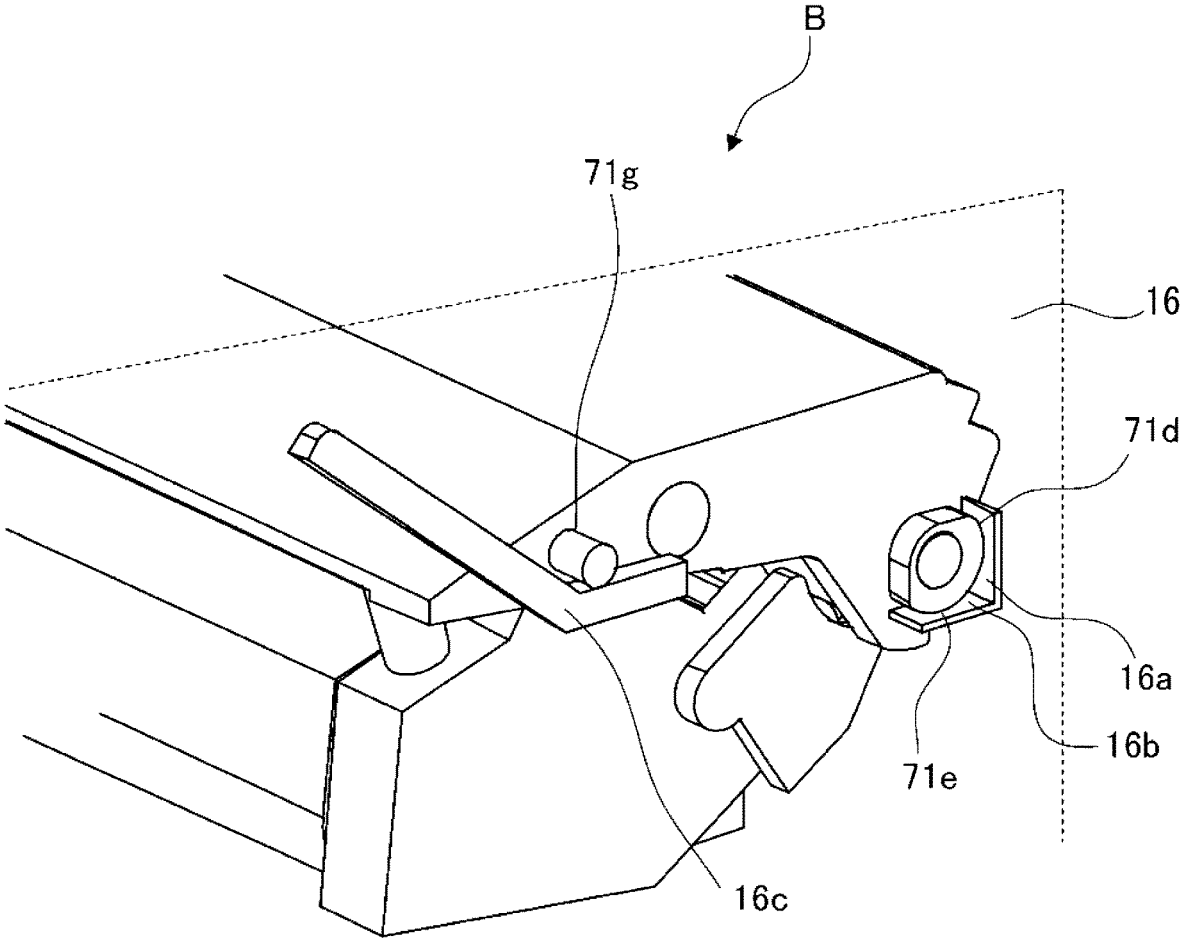

FIG. 9 is an enlarged perspective view of the cartridge according to the first embodiment and a non-driving side positioning portion of the apparatus main assembly A in the state in which the cartridge is mounted in the apparatus main assembly A.

Figure 10:
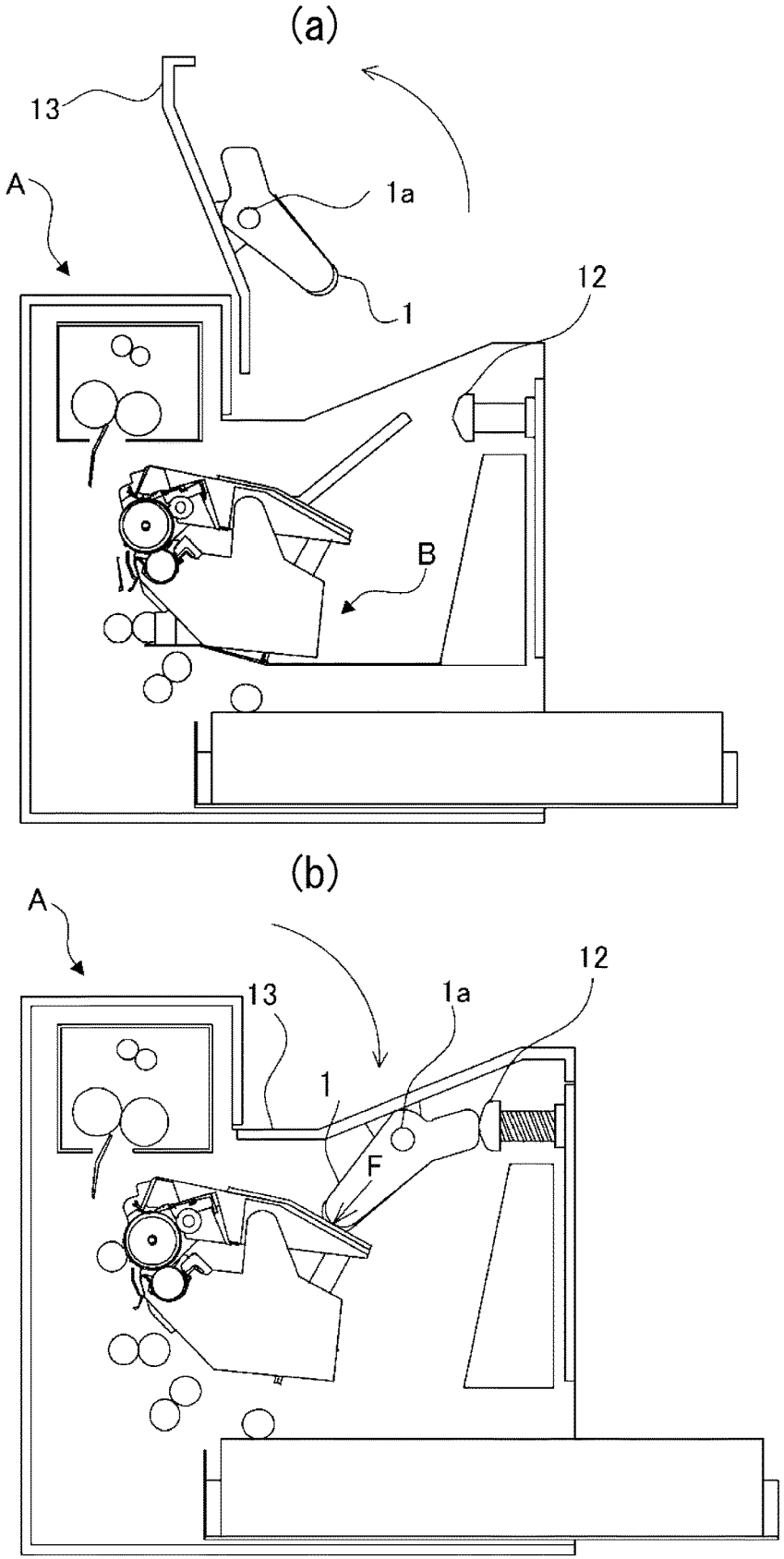

Parts (a) and (b) of FIG. 10 are schematic sectional front views showing a state in which the cartridge according to the first embodiment is mounted in the apparatus main assembly.

Figure 11:
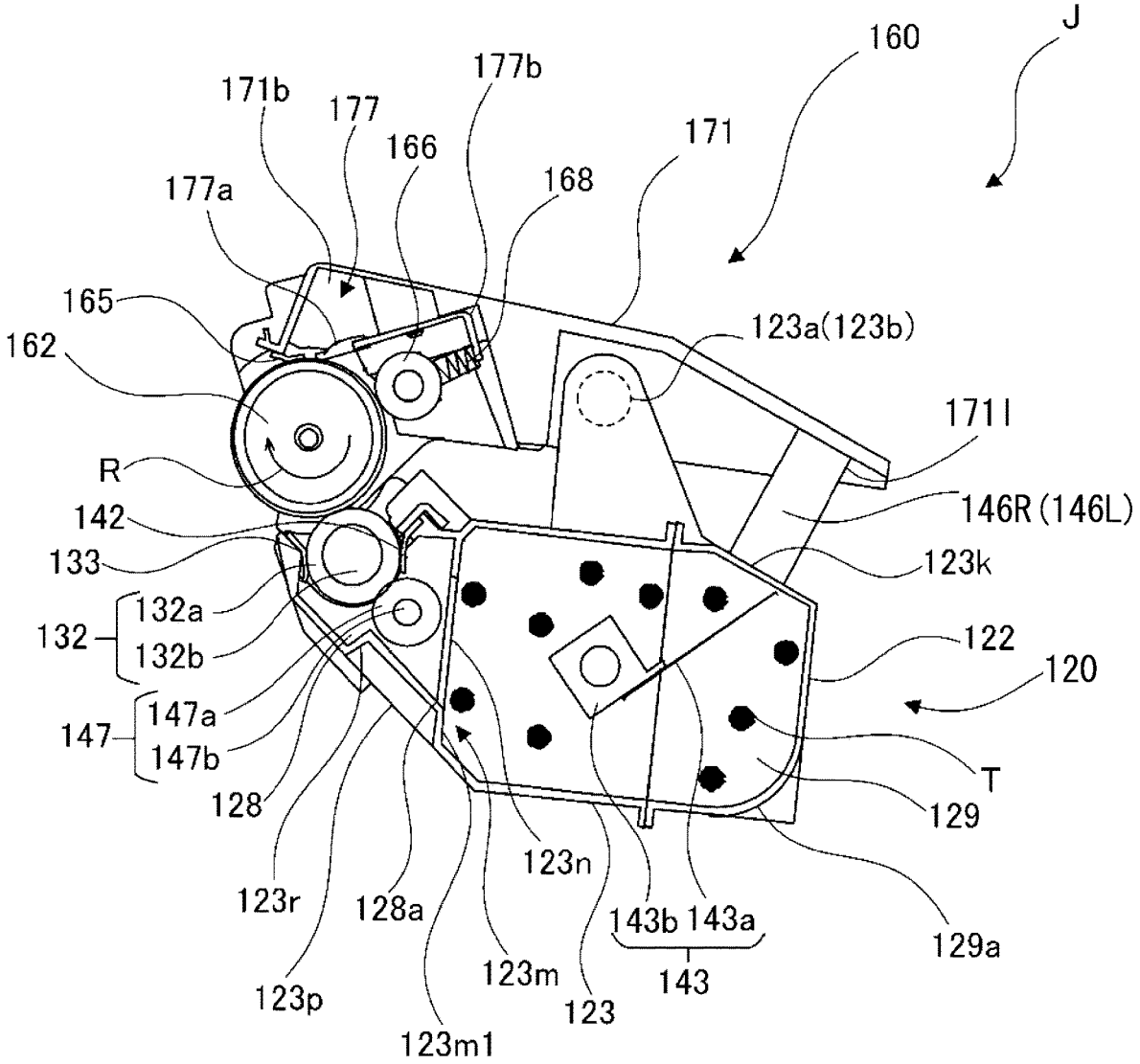

FIG. 11 is an enlarged sectional front view of a cartridge according to a second embodiment of the present invention.

Figure 12:
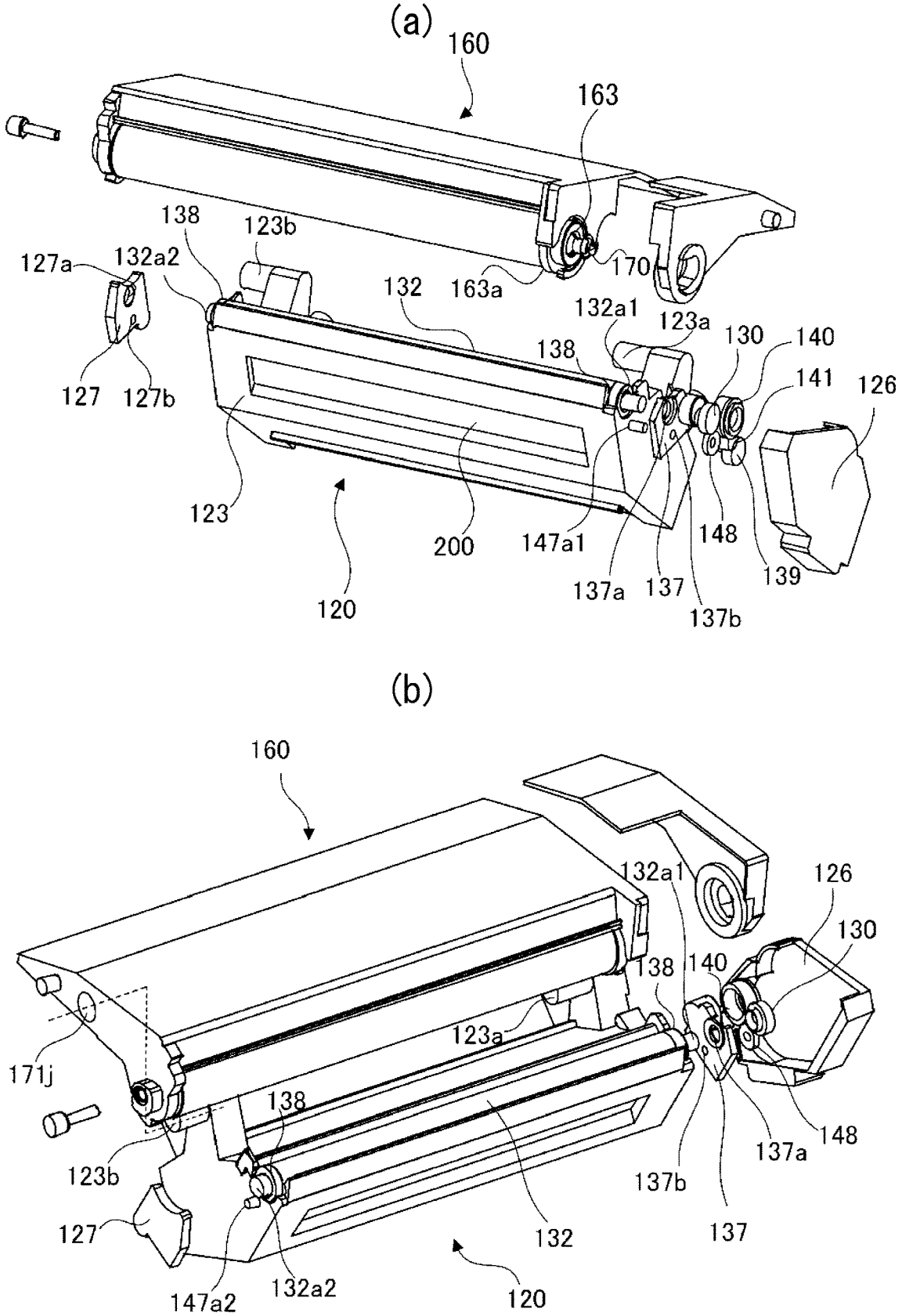

Parts (a) and (b) of FIG. 12 are exploded perspective views of the cartridge according to the second embodiment.

Figure 13:
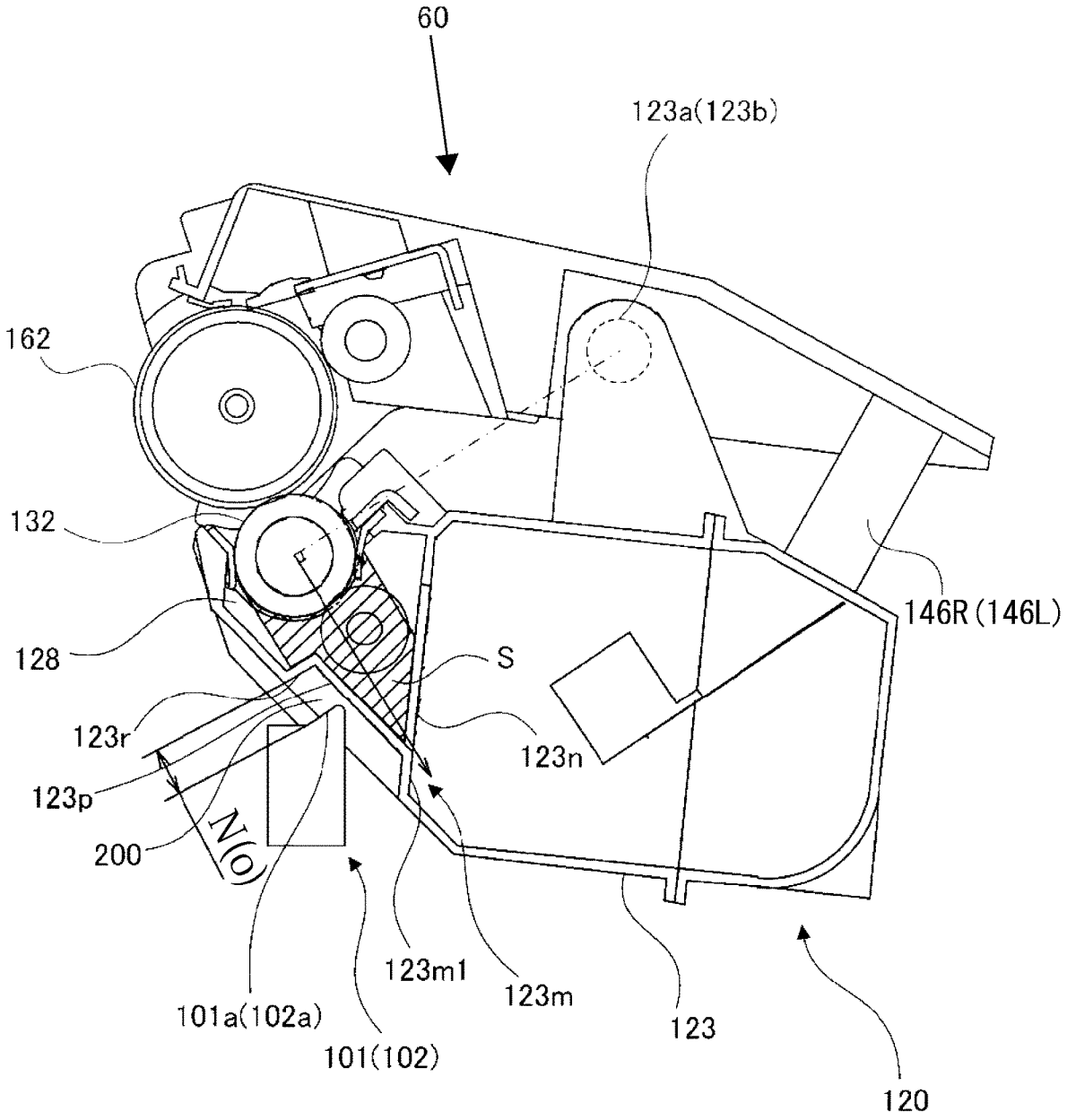

FIG. 13 is a sectional front view of a principal part of the cartridge according to the second embodiment in a state in which the cartridge is mounted in an apparatus main assembly.

DESCRIPTION OF EMBODIMENTS

In the following, embodiments of the present invention will be described in detail. Incidentally, constituent elements described in the following embodiments are examples, and various conditions such as structures, functions, materials, shapes, relative arrangements and the like of a device and an apparatus to which the present invention is applicable can be appropriately modified or changed within a scope of the present invention, and are not limited to those in the following embodiments.

Incidentally, in the following description, a rotational axis direction of an electrophotographic photosensitive drum is a longitudinal direction. Further, with respect to the longitudinal direction, a side in which the photosensitive drum receives a driving force from an apparatus main assembly is a driving side, and an opposite side thereof is a non-driving side.

First Embodiment

Figure 2:
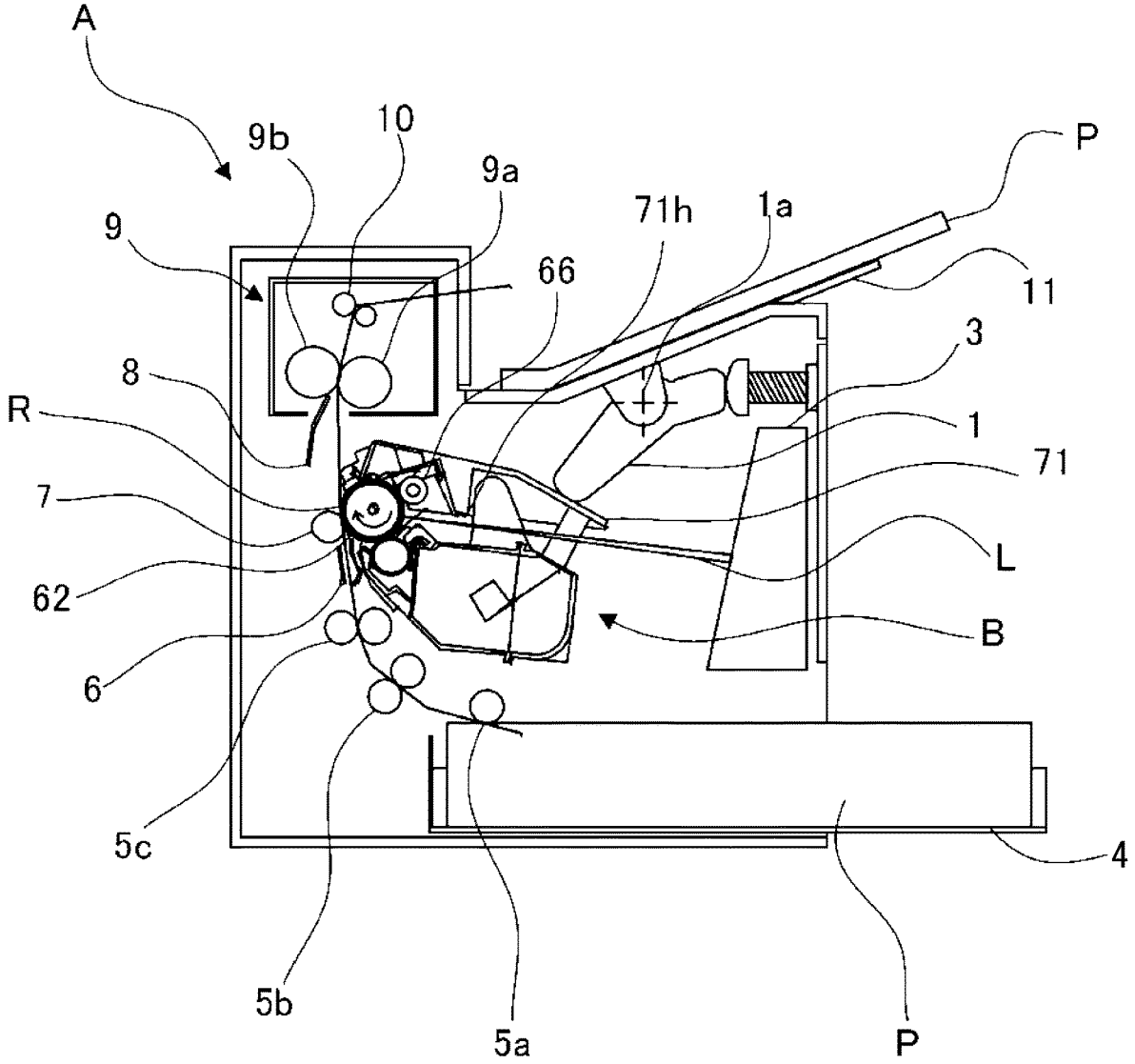
FIG. 2 is a schematic sectional front view of an image forming apparatus according to the first embodiment.
Figure 3:
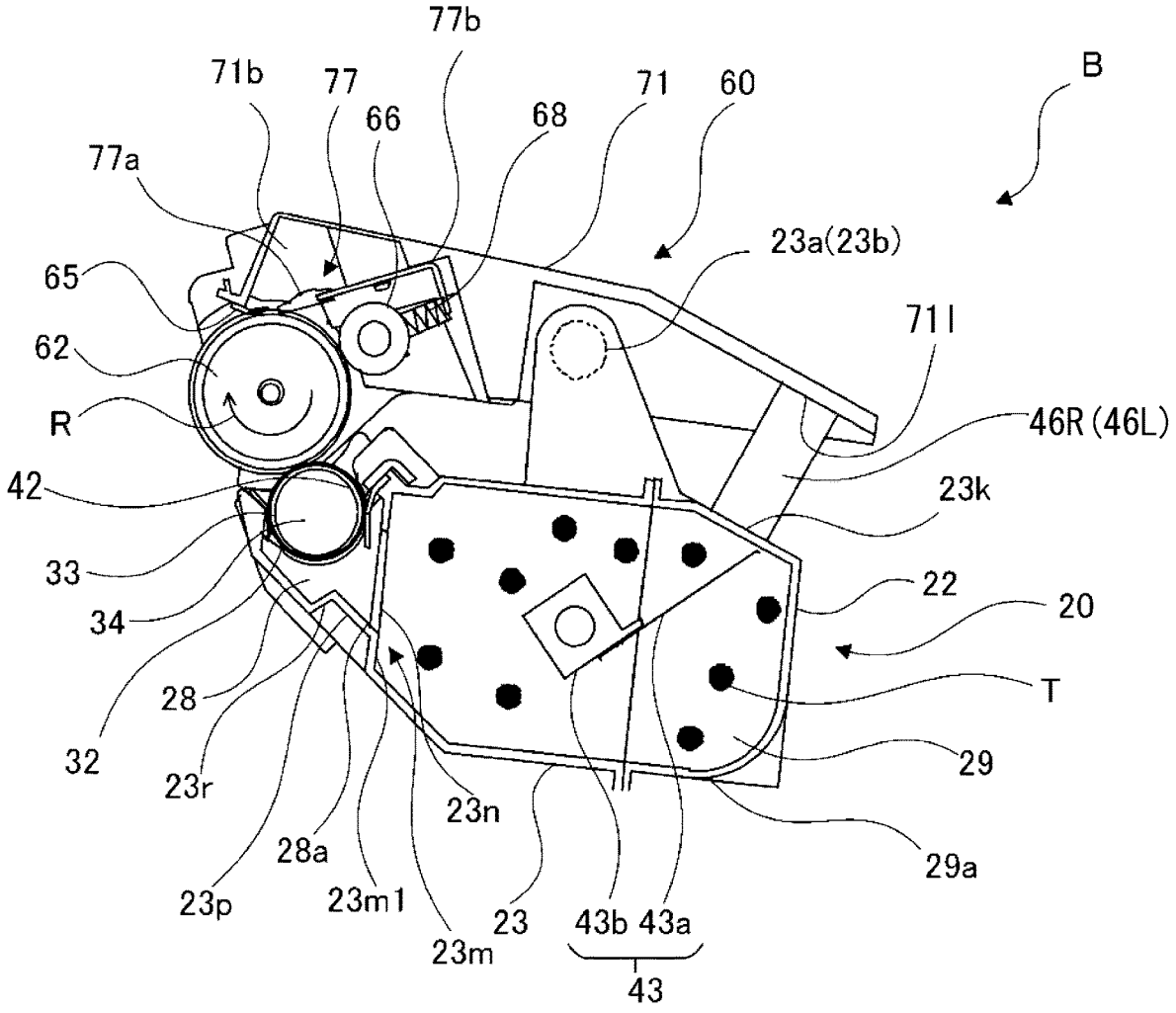
FIG. 3 is an enlarged sectional front view of the cartridge of FIG. 2 according to the first embodiment.

FIG. 2 is a schematic sectional front view of an image forming apparatus main assembly A and a process cartridge B of an image forming apparatus of an electrophotographic type according to a first embodiment of the present invention, and FIG. 3 is an enlarged sectional front view of the cartridge B of FIG. 2. Here, the apparatus main assembly A is a portion of the image forming apparatus from which the cartridge B is removed.

In FIG. 2, the apparatus main assembly A is a laser beam printer using electrophotography in which the cartridge B is mountable in and dismountable from the apparatus main assembly A. An exposure device 3 (laser scanner unit) is provided in the apparatus main assembly A so that in a state in which the cartridge B is mounted in the apparatus main assembly A, a latent image is formed on an electrophotographic photosensitive drum (hereinafter referred to as a drum) 62 as an image bearing member. Further, below the cartridge B of the apparatus main assembly A, a sheet (feeding) tray 4 in which a recording material (hereinafter referred to as a sheet material) P, such as a print sheet, to be subjected to image formation is accommodated is provided.

Further, in the apparatus main assembly A, from below toward above, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

An outline of an image forming process will be described. In FIGS. 2 and 3, by a print start signal, the drum 62 is rotationally driven at a predetermined peripheral speed (process speed) in an arrow R direction. Further, a charging roller 66 to which a bias voltage is applied contacts an outer peripheral surface of the drum 62 and electrically charges the outer peripheral surface of the drum 62 uniformly. The exposure device 3 outputs laser light L depending on image information. The laser light L passes through a laser opening 71*h* provided in a cleaning frame 71, so that the outer peripheral surface of the drum 62 is subjected to scanning exposure. As a result, on the outer peripheral surface of the drum 62, an electrostatic latent image corresponding to the image information is formed.

On the other hand, in FIG. 3, in a developing unit 20 constituting a developing device, a toner T in a toner chamber 29 as a toner supplying chamber is stirred and fed by rotation of a first feeding member 43, and thus is sent to a toner supplying chamber 28 as a developing chamber. The toner T is carried on a surface of a developing roller 32 as a developer carrying member by a magnetic force of a magnet roller 34 (fixed magnet). The toner T is regulated in layer thickness on the peripheral surface of the developing roller 32 by a developing blade 42 while being triboelectrically charged. The toner T is supplied to the drum 62 and is used for developing the electrostatic latent image, and visualizes the electrostatic latent image into a toner image.

Further, in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11.

On the other hand, in FIG. 3, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60 as a frame including the drum 62.

In the above, the charging roller 66, the developing roller 32, the transfer blade 7 and the cleaning blade 77 are process means actable on the drum 62.

Figure 1:
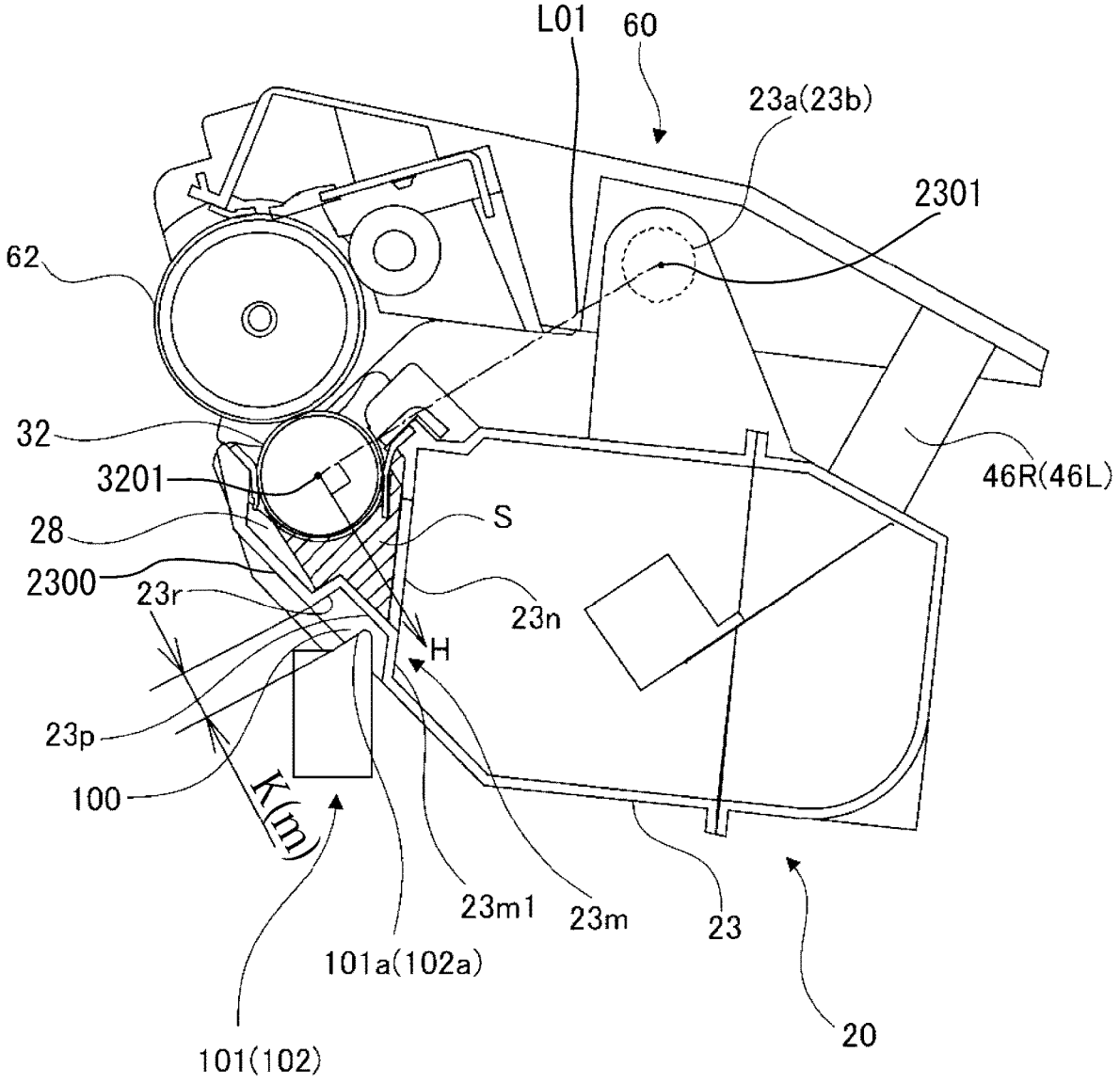
FIG. 1 is a schematic sectional front view of a principal part of a cartridge according to a first embodiment of the present invention in a state in which the cartridge is mounted in an apparatus main assembly.
Figure 4:
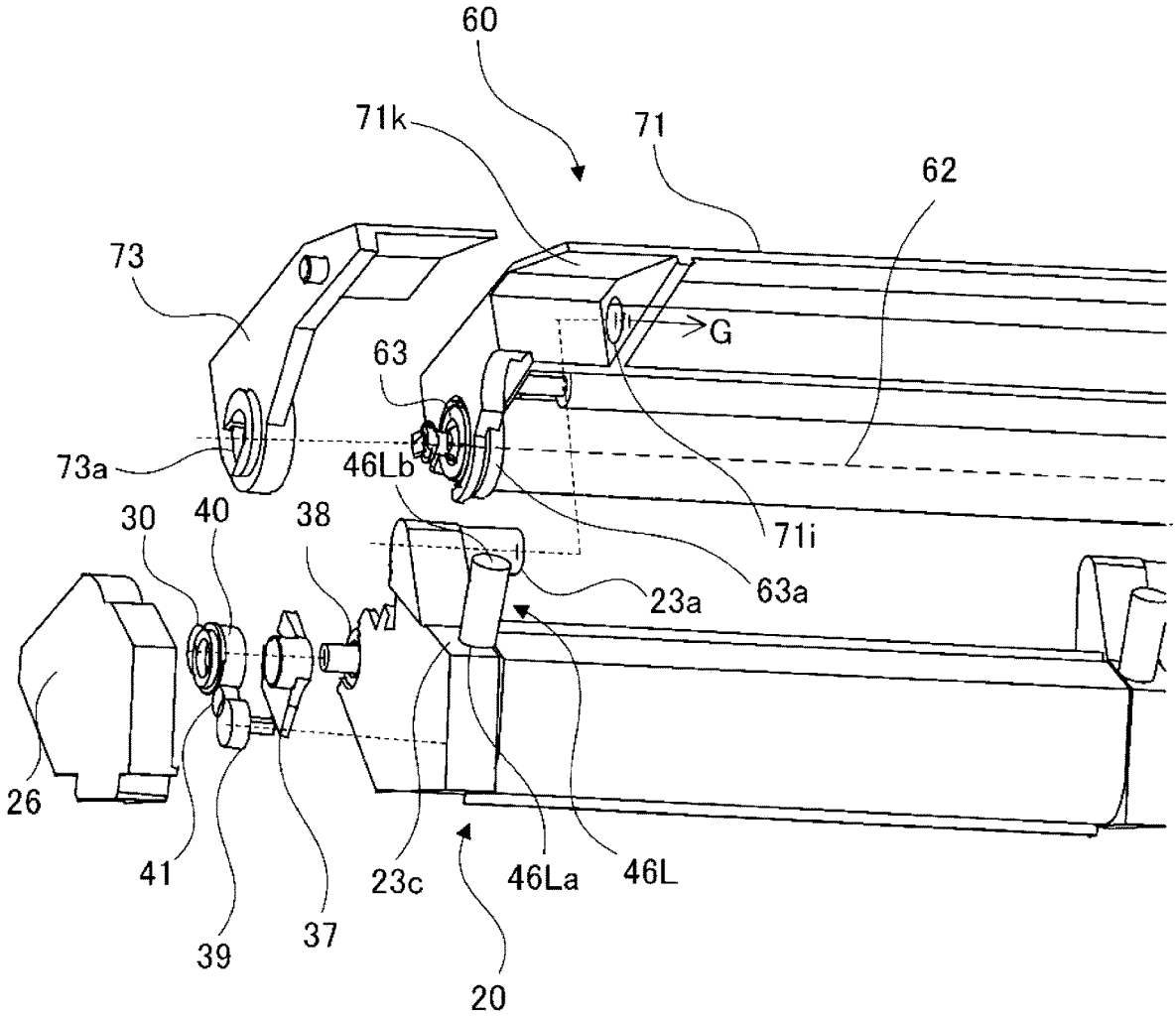
FIG. 4 is an exploded perspective view of the cartridge according to the first embodiment as seen from a driving side.
Figure 5:
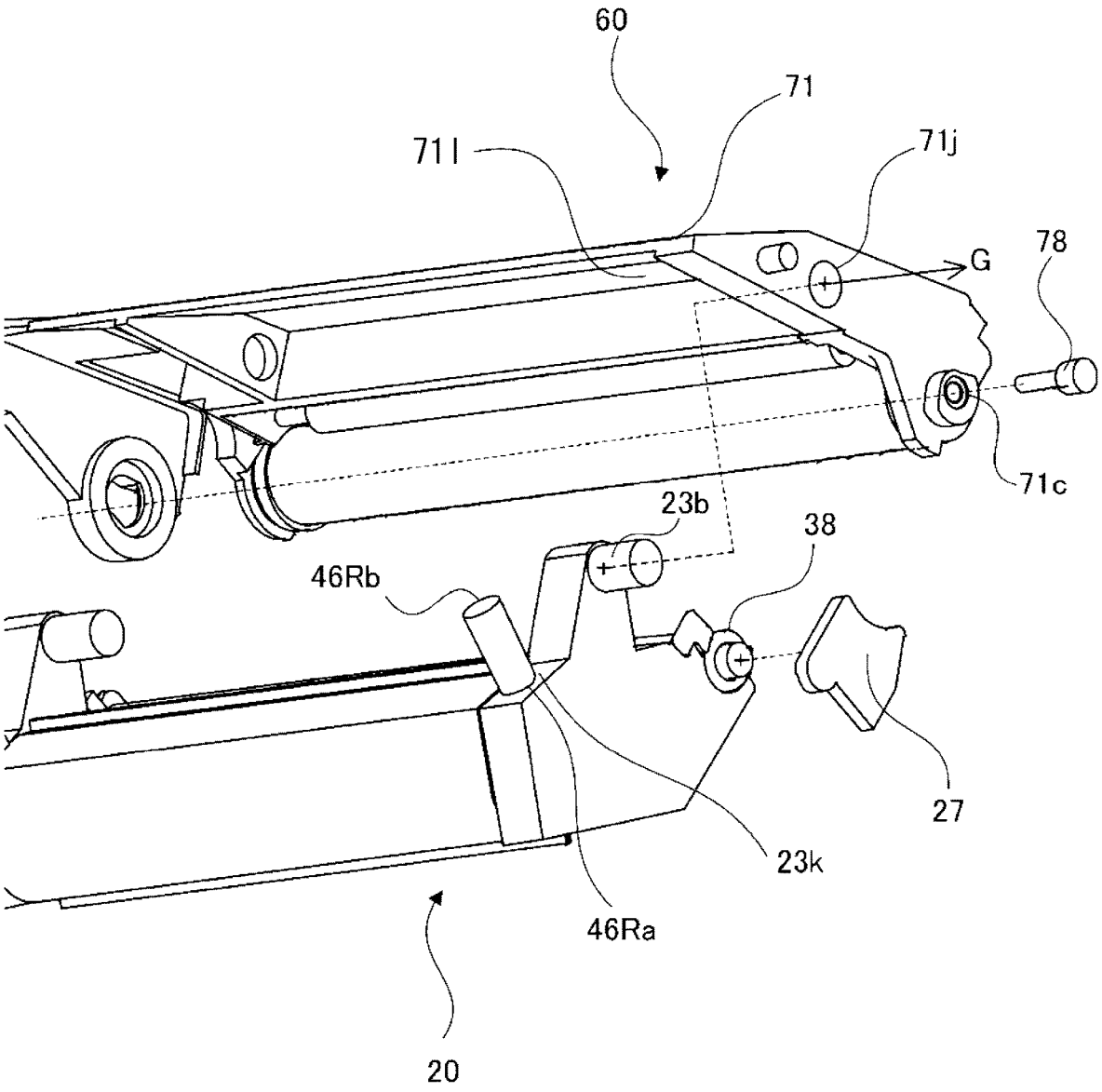
FIG. 5 is an exploded perspective view of the cartridge according to the first embodiment as seen from a non-driving side.
Figure 6:
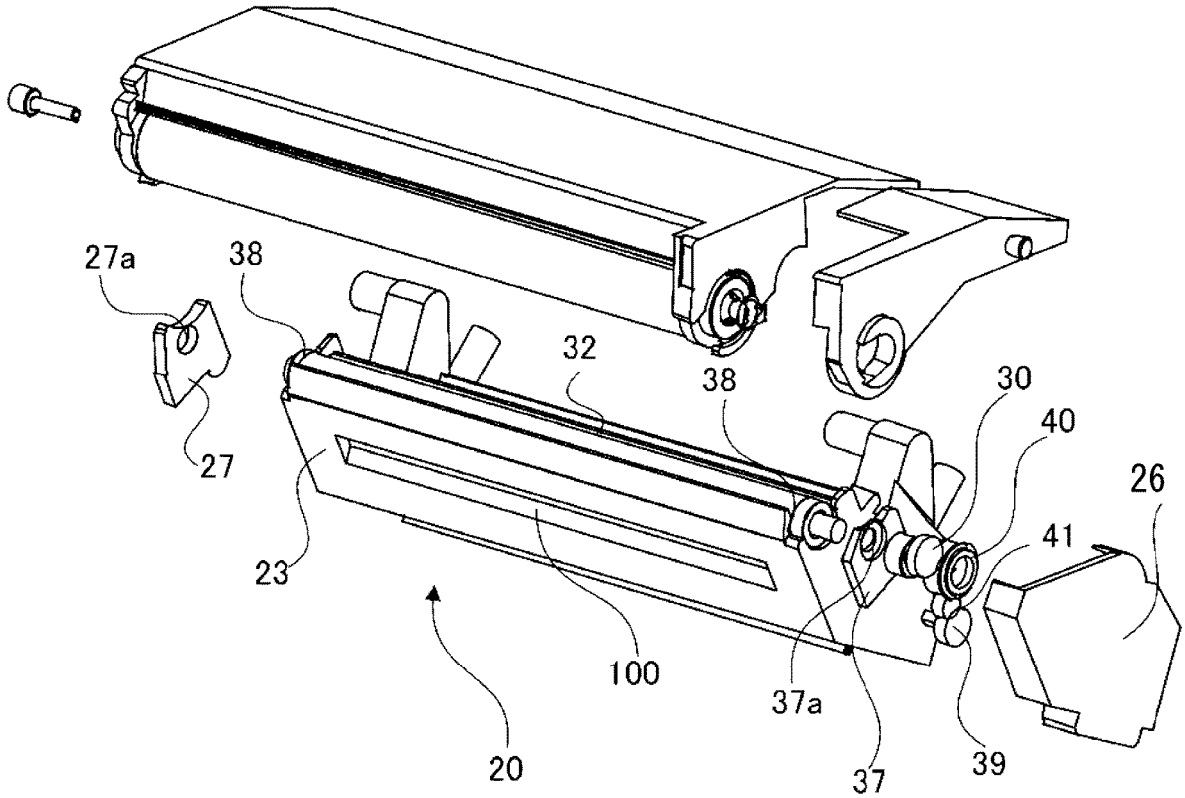
FIG. 6 is an exploded perspective view of the cartridge according to the first embodiment as seen from a rear surface side.

A general structure of the cartridge B will be described using FIGS. 1 and 3 to 6. FIG. 1 is a sectional front view of a principal part of the cartridge B in a state in which the cartridge B is mounted in the apparatus main assembly A. FIG. 4 is an exploded perspective view of the cartridge B as seen from a driving side. FIG. 5 is an exploded perspective view of the cartridge B as seen from a non-driving side. FIG. 6 is an exploded perspective view of the cartridge B of FIG. 5 as seen from a rear surface side. Incidentally, in the following description, screws during connection of respective component parts are omitted.

In FIGS. 3 to 6, the cartridge B includes the cleaning unit 60 and the developing unit 20. Incidentally, the process cartridge is prepared by integrally assembling the electrophotographic photosensitive member and at least one of the charging unit, the developing unit and the cleaning unit as process means actable on the photosensitive member, into a cartridge, and is made mountable in and dismountable from the image forming apparatus main assembly.

As shown in FIG. 3, the cleaning unit 60 as a first frame includes the drum 62, the charging roller 66, a cleaning blade 77, and a cleaning frame 71 supporting these members. In the cleaning unit 60, each of the charging roller 66 and the cleaning blade 77 is disposed in contact with the outer peripheral surface of the photosensitive drum 62.

The cleaning blade 77 includes a rubber blade 77*a* which is a blade-shaped elastic member formed with a rubber as an elastic member, and a supporting member 77*b* for supporting the rubber blade 77*a*. The rubber blade 77*a* counterdirectionally contacts the drum 62 with respect to a rotational direction of the drum 62. That is, the rubber blade 77*a* contacts the drum 62 so that a free end portion thereof extends toward an upstream side with respect to the rotational direction of the drum 62.

Residual (waste) toner removed from the surface of the drum 62 by the cleaning blade 77 is stored in a residual (waste) toner chamber 71*b* formed by the cleaning frame 71 and the cleaning blade 77.

Further, a sheet member 65 for preventing leakage-out of the residual toner from the cleaning frame 71 is provided on an edge portion of the cleaning frame 71 so as to contact the drum 62.

The drum 62 is rotationally driven in the arrow R direction depending on an image forming apparatus by receiving a driving force from a main assembly driving motor (not shown) which is a driving source. The charging roller 66 is rotatably mounted in the cleaning unit 60 via charging roller bearings (not shown) at opposite end portions with respect to a longitudinal direction (substantially parallel to a rotational axis direction of the drum 62) of the cleaning frame 71. The charging roller 66 is press-contacted to the drum 62 by being urged at the charging member bearings against the drum 62 by an urging member 68. The charging roller 66 is rotated by rotation of the drum 62.

The developing unit 20 as a second frame (developing frame) includes a toner chamber 29 constituted by a developing container 23 and a cap member 22 and includes a toner supplying chamber 28. During image formation, a lowermost portion 29*a* of the toner chamber 29 is disposed at a position below a lowermost portion 28*a* of the toner supplying chamber 28 with respect to the direction of gravitation, and the toner chamber 29 and the toner supplying chamber 28 are partitioned by a partition wall 23*m* which is a part of the process cartridge 23.

In the toner chamber 29, toner T is accommodated, and the feeding member 43 for not only stirring the toner T accommodated in the toner chamber 29 but also feeding the toner T toward the toner supplying chamber 28 is provided. The feeding member 43 is constituted by a feeding sheet 43*a* and a feeding member rotation shaft 43*b*.

At a side surface of the toner chamber 29, the partition wall 23*m* is provided with an opening 23*a* communicating the toner chamber 29 and the toner supplying chamber 28 for supplying the toner T toward the toner supplying chamber 28. In the toner supplying chamber 28, the developing roller 32 opposing the drum 62 is disposed. The developing roller 32 is supported, as shown in FIG. 6, by a bearing portion 27*a* of a bearing member 27 provided on one end side thereof with respect to an axial direction and by a bearing portion 37*a* of a bearing member 37 provided on the other end side thereof with respect to the axial direction.

As a result, the developing roller 32 is rotatably mounted to the developing container 23.

Inside the developing roller 32, as shown in FIG. 3, a magnet roller 34 is provided. In the developing unit 20, the developing blade 42 for regulating a toner layer on the developing roller 32 is disposed.

At opposite end portions of the developing roller 32 with respect to the rotational axis direction, as shown in FIGS. 4 to 6, gap retaining members 38 are mounted, and by contact of the gap retaining members 38 with the drum 62, the developing roller 32 is held with a minute gap between itself and the drum 62.

Further, as shown in FIG. 3, a sheet member 33 for preventing leakage of the toner from the developing unit 20 is provided at an edge portion of the developing roller 32 so as to contact the developing roller 32.

The developing container 23 of the developing unit 20 is provided with a first developing (device) supporting boss 23*a* (first shaft) and a second developing (device) supporting boss 23*b* (second shaft) which are used as portions-to-be-supported provided on a toner chamber 29 side which is a side different from a developing roller 32 side with respect to a surface where the partition wall 23*m* is disposed. That is, the first developing supporting boss 23*a* (first shaft) is provided at one end of a second frame (developing unit 20) with respect to a longitudinal direction, and the second developing supporting boss 23*b* (second shaft) is provided on the other end of the second frame (developing unit 20)

with respect to the longitudinal direction. Incidentally, the first developing supporting boss (first shaft) and the second developing supporting boss (second shaft) are coaxially disposed ("swing shaft 2301" described later).

Further, as shown in FIGS. 4 and 5, the developing unit 20 is connected to the cleaning unit 60 by supporting the first developing supporting boss 23*a* and the second developing supporting boss 23*b* by a first hanging hole 71*i* and a second hanging hole 71*j*, respectively. As a result, the second frame (developing unit 20) is swingable about axes of the first and second shafts as the swing axis 2301.

In a state in which the cartridge B is positioned in the apparatus main assembly A, as shown in FIG. 1, at a lower portion of the toner supplying chamber 28 and below the developing roller 32 with respect to the direction of gravitation, a recessed portion 100 formed by depressing an outer configuration portion of the process cartridge 23 toward an inside of the toner supplying chamber 28 is provided. The recessed portion 100 is disposed at a position remoter from the drum 62 than from the developing roller 32 as seen from the drum 62. Incidentally, it can also be said that the recessed portion 100 is a projection (100) formed by depressing a part of an outer surface 2300 of the developing frame (second frame) so as to project toward an inside of the frame.

The recessed portion 100 is constituted by a lower portion 23*m*1 of the partition wall 23*m*, a first surface 23*p* forming a lower end surface of the opening 23*n*, and a second surface 23*r* as a contact surface which is a side surface of the recessed portion 100 recessed toward the inside of the toner supplying chamber 28. In a cross-section perpendicular to an axial direction of the rotation shaft of the developing roller 32, the second surface 23*r* includes a surface at least partially overlapping with the developing roller 32 as seen in an arrow H direction perpendicular to a rectilinear line L01 connecting a rotation center of the developing roller 32 and a swing center of the first developing supporting boss 23*a* (first shaft) and the second developing supporting boss 23*b* (second shaft). That is, in the cross-section (shown in FIG. 1) perpendicular to the axial direction of the rotation axis (3201) of the developer carrying member (32), as seen in the direction (H) perpendicular to the rectilinear line L01 connecting the swing axis 2301 of the developing unit 20 and the rotation center (rotation axis 3201) of the developer carrying member (32), the developer carrying member (32) and the projection (100) are disposed so as to partially overlap with each other.

As shown in FIGS. 4 and 5, the cartridge B is constituted by combining the cleaning unit 60 and the developing unit 20. The cleaning unit 60 includes the cleaning frame 71, the drum 62, a drum bearing 73 rotatably supporting the drum 62, and a drum shaft 78. As shown in FIG. 4, on the driving side, as regards the drum 62, a driving side drum flange 63 provided on the driving side is rotatably supported by a hole 73*a* as a supporting portion of the drum bearing 73. On the other hand, on the non-driving side, as shown in FIG. 5, the drum shaft 78 press-fitted in a hole 71*c* as a supporting portion provided in the cleaning frame 71 rotatably supports a hole (not shown) of a non-driving side drum 64.

During connection between the developing unit 20 and the cleaning unit 60, first, a center of the first developing supporting boss 23*a* as a portion-to-be-supported of the developing container 23 for the first handing hole 71 of the cleaning frame 71 on the driving side is aligned with a center of the first hanging hole. Similarly, a center of the second developing supporting boss 23*b* as a portion-to-be-supported for the second hanging hole 71*j* on the non-driving side is aligned with a center of the second hanging hole 71*j*. Specifically, by moving the developing unit 20 in an arrow G direction, the first developing supporting boss 23*a* and the second developing supporting boss 23*b* engage in the first hanging hole 71*i* and the second hanging hole 71*j*, respectively. As a result, the developing unit 20 is swingably connected to the cleaning unit 60. Thereafter, the drum bearing 73 is assembled with the cleaning unit 60, so that the cartridge B is prepared.

Further, a first end portion 46La of a driving side urging member 46L as an urging member constituting the developing device is fixed to a surface 23*c* of the developing container 23, and a second end portion 46Lb contacts a surface 71*k* which is a part of the cleaning unit 60. Further, a first end portion 46Ra of a non-driving side urging member 46R as an urging member is fixed to a surface 23*k* of the developing container 23, and a second end portion 46Rb contacts a surface 71*l* which is a part of the cleaning unit 60.

In this embodiment, each of the driving-side urging member 46L and the non-driving-side urging member 46R is formed with a compression spring. The developing unit 20 is urged toward the cleaning unit 60 by an urging force of these springs, so that the developing roller 32 is constituted so as to be pressed toward the drum 62. Then, by the gap retaining members 38 provided at the end portions of the developing roller 32, the developing roller 32 is held with a predetermined minute gap with the drum 62. Incidentally, the driving side urging member 46L and the non-driving side urging member 46R are shown by a cylinder for simplification.

Next, mounting and dismounting of the cartridge B will be described using FIGS. 7 to 9.

Parts (a) and (b) of FIG. 7 are perspective views of the apparatus main assembly A and the cartridge B during mounting and dismounting of the cartridge B, in which part (a) is the perspective view of the cartridge B as seen from the driving side, and part (b) is the perspective view of the cartridge B as seen from the non-driving side. FIG. 8 is an enlarged perspective view of a driving side positioning portion between the cartridge B and the apparatus main assembly A in a state in which the cartridge B is mounted in the apparatus main assembly A. FIG. 9 is an enlarged perspective view of a non-driving side positioning portion between the cartridge B and the apparatus main assembly A in a state in which the cartridge B is mounted in the apparatus main assembly A.

In FIG. 7, to the apparatus main assembly A, an openable door 13 as an openable member is mounted swingably (in an arrow I direction), and when this openable door 13 is opened, a cartridge insertion opening 17 is exposed. When the cartridge B is inserted into the apparatus main assembly A, the cartridge B is inserted in an arrow C direction along a guiding rail (not shown) provided in the apparatus main assembly A. When in the apparatus main assembly A, the cartridge B is inserted in the arrow C direction until the cartridge B reaches an image formable position and then the openable door 13 is closed, a mounting operation of the cartridge B into the apparatus main assembly A is completed.

Further, as shown in FIG. 8, the apparatus main assembly A is provided with a driving portion 14 for transmitting drive (driving portion) to an engaging portion 70 provided to the cartridge B. The driving portion 14 is driven by a motor (not shown) of the apparatus main assembly A. As a result, the drum 62 connected to the engaging portion 70 is rotated by receiving a driving force from the apparatus main assembly A.

Further, the driving force is transmitted from drum gear 63*a* provided on the driving side drum flange 63 to a developing roller gear 30, so that the developing roller 32 is rotated. The driving force is transmitted from the developing roller gear 30 to a feeding gear 39 via idler gears 40 and 41, so that the feeding member 43 shown in FIG. 3 is rotated. The charging roller 66 and the developing roller 32 are energized by an energizing portion (not shown) of the apparatus main assembly A.

Driving force transmission from the apparatus main assembly A to the cartridge B is not limited to this form, but may also be form such that drive is transmitted from the apparatus main assembly to each of the drum and the developing roller.

As shown in FIG. 7, the apparatus main assembly A is provided with a driving side plate 15 and a non-driving side plate 16 which are supporting portions for supporting the cartridge B. As shown in FIGS. 8 and 9, the driving side plate 15 is provided with a first driving side supporting portion 15*a* and a second driving side supporting portion 15*b* which constitute the positioning portion and provided with a rotation supporting portion 15*c* as a rotation preventing portion of the cartridge B. Similarly, the non-driving side plate 16 is provided with a first non-driving side supporting portion 16*a* and a second non-driving side supporting portion 16*b* which constitute the positioning portion and provided with a rotation supporting portion 16*c* as a rotation preventing portion.

On the other hand, as portions-to-be-supported where the cartridge B is supported, a portion-to-be-supported 73*b* and a portion-to-be-supported 73*d* which are portions-to-be-positioned of the drum bearing 73 and a driving side boss 73*c* which is a portion where rotation is prevented are provided. The cleaning frame 71 is provided with a portion-to-be-supported 71*d* and a portion-to-be-supported 71*e* which are portion-to-be-positioned and a non-driving side boss 71*g* which is a portion where rotation is prevented.

On the driving side, the portion-to-be-supported 73*b* and the portion-to-be-supported 73*d* are positioned and supported by the first driving side supporting portion 15*a* and the second driving side supporting portion 15*b*, respectively, and the driving side boss 73*c* is rotation-prevented and supported by the rotation supporting portion 15*c*. On the non-driving side, the portion-to-be-supported 71*d* and the portion-to-be-supported 71*e* are positioned and supported by the first non-driving side supporting portion 16*a* and the second non-driving side supporting portion 16*b*, respectively, and the non-driving side boss 71*g* is rotation-prevented and supported by the rotation supporting portion 16*c*.

Parts (a) and (b) of FIG. 10 are schematic sectional front views of the apparatus main assembly A and the cartridge B in a state in which the cartridge B is mounted in the apparatus main assembly A, in which part (a) shows an open state of the openable door 13, and part (b) shows a closed state of the openable door 13. As shown in FIG. 10, the openable door 13 is provided with a cartridge urging member 1. The cartridge urging member 1 is swingable about a fulcrum 1*a* as a center.

When the state of the openable door 13 is changed from the open state of part (a) of FIG. 10 to the closed state of part (b) of FIG. 10, in interrelation with this operation, the cartridge urging member 1 is also moved from a position of part (a) of FIG. 10 to a position of part (b) of FIG. 10. At this time, by an urging member 12 provided in the apparatus main assembly A, the cartridge urging member 1 is urged against the cartridge B in an arrow F direction. This urging force is received by the first driving side supporting portion 15*a*, the second driving side supporting portion 15*b*, the rotation supporting portion 15*c*, the first non-driving side supporting portion 16*a*, the second non-driving side supporting portion 16*b*, and the rotation supporting portion 16*c* which are shown in FIGS. 8 and 9, so that the cartridge B is positioned in the apparatus main assembly A.

As shown in FIGS. 1 and 7, the apparatus main assembly A is provided with a driving side restricting member 101 and a non-driving side restricting member 102 which are restricting members for restricting movement of the developing unit 20. The driving side restricting member 101 and the non-driving side restricting member 102 are disposed on opposite end portion sides of a driving side end portion and a non-driving side end portion of the developing roller 32 of the developing unit 20 with respect to the rotational axis direction of the developing roller 32, respectively. The driving side restricting member includes a movement restricting portion 101*a*. Similarly, the non-driving side restricting member 102 includes a movement restricting portion 102*a*.

The driving side restricting member 101 and the non-driving side restricting member 102 are configured so that when the cartridge B is inserted into the apparatus main assembly A, as shown in FIG. 1, these members can enter the recessed portion 100 provided at a lower surface of the developing container 23. In a state in which the cartridge B is positioned relative to the apparatus main assembly A, the movement restricting portion 101*a* and the movement restricting portion 102*a* oppose the second surface 23*r*.

Further, a gap k is provided between the movement restricting portion 101*a* and the second surface 23*r*. Similarly, a gap m is provided between the movement restricting portion 102*a* and the second surface 23*r*. The gaps k and m are determined in consideration of variations in component part dimension, or the like, and in the state in which the cartridge B is mounted in the apparatus main assembly A, the gaps are set so as to be always certain gaps. Therefore, in the state in which the cartridge B is mounted in the apparatus main assembly A, the driving side restricting member 101 and the non-driving side restricting member 102 do not contact a constituent component part (for example, the developing container 23) constituting the cartridge B.

As described above, the developing unit 20 is connected to the cleaning unit 60 swingably about the first and second developing supporting bosses 23*a* and 23*b* of the developing container 23 as a swing center. By the driving side urging member 46L and the non-driving side urging member 46R, the developing unit 20 is urged about the first and second developing supporting bosses 23*a* and 23*b* against the cleaning unit 60 in an attitude during use, so that the developing roller 32 is pressed toward a direction of the drum 62. Then, the developing roller 32 is held with a predetermined gap from the drum 62 by the gap retaining members 38 shown in FIGS. 4 and 5.

Therefore, the developing unit 20 is positioned only relative to the cleaning unit 60, so that a good image can be obtained without obstructing setting of the developing unit 20 during image formation.

In recent years, a type of packing including the cartridge in the main assembly during shipping such that the cartridge B is included in the apparatus main assembly A during shipping of the apparatus main assembly A has been taken so that a user can use the apparatus main assembly A immediately after purchase. In this type of packing including the cartridge in the main assembly, after shipping from a factory, these is a possibility that vibration and impact due to transportation are exerted on the cartridge B included in the apparatus main assembly A.

As described above, the developing unit 20 is connected to the cleaning unit 60 swingably about the first and second developing supporting bosses 23*a* and 23*b* of the developing container 23 the swing center. Further, the driving side urging member 46L and the non-driving side urging member 46R swing and urge the developing unit 20 toward the cleaning unit 60 about the first and second developing supporting bosses 23*a* and 23*b* of the developing container 23 as the swing center. As a result, the developing roller 32 is pressed toward the drum 62.

On the other hand, the vibration and the impact due to transportation are exerted on the cartridge B packed in the apparatus main assembly A, so that the developing unit 20 is liable to be swung, in a second direction opposite to a first direction which is an urging direction, against an urging force toward the cleaning unit 60 in some cases. That is, in some cases, the developing unit 20 is liable to swing in the second direction opposite to the first direction (urging direction) in a distance which is not less than each of the gaps (k and m) between the movement restricting portion (101*a* and 102*a*) and the second surface 23*r*.

In such a case, the second surface 23*r* positioned downstream of the movement restricting portions 101*a* and 102*a* with respect to the first direction is contactable to the movement restricting portions 101*a* and 102*a* and restricts swing (movement amount) of the developing unit 20. As a result, by the driving side urging member 46L and the non-driving side urging member 46R, a force of collision of the developing unit 20 with the cleaning unit 60 due to swing back can be suppressed to a certain level. As a result, it is possible to prevent breakage or the like of component parts.

Incidentally, as described above, the recessed portion 100 is formed by depressing the outer configuration portion of the developing container 23, positioned below the developing roller 32 with respect to the direction of gravitation, toward the inside of the toner supplying chamber 28. As a result, a distance between the magnet roller 34 and the second surface 23*r* which is the lower surface portion of the toner supplying chamber 28 decreases. Accordingly, the toner accumulated in the neighborhood of the lower surface of the toner supplying chamber 28 can be attracted to the magnet roller 34 without excessively increasing a magnetic force of the magnet roller 34, so that an amount of residual toner which generates due to a decrease in the toner in the toner supplying chamber 28 and which remains in the toner supplying chamber 28 without being used for development can be reduced.

That is, according to the first embodiment of the present invention, it is possible to compatibly realize effective suppression of the impact during shipping transportation and efficient decrease in residual toner amount in the developing device using the magnet roller.

Further, by providing the second surface 23*r* in the neighborhood of a place where of the component parts used for the developing unit 20, component parts (the developing roller 32, the developing blade 42, the magnet roller 34) which are high in weight ratio are disposed, it is possible to dispose the second surface 23*r* without excessively increasing rigidity of the frame.

The movement restricting portions 101*a* and 102*a* are caused to oppose the second surface 23*r* on both end portion sides of the developing unit 20. As a result, the second surface 23*r* can contact the movement restricting portions 101*a* and 102*a* at high rigidity portions of the frame close to the bearings 27 and 37 provided at end portions of the developing container 23, so that a vibration absorbing performance and an impact absorbing performance during transportation can be efficiently enhanced.

Further, the recessed portion 100 is provided at the lower surface of the developing container 23, whereby the rigidity of the frame in the neighborhood of the toner supplying chamber 28 can be enhanced, so that entire strength of the developing unit 20 is increased. As a result, when the developing unit 20 is urged toward the cleaning unit 60, deformation of the developing unit 20 is suppressed, so that a force for pressing the developing roller 32 toward the drum 62 can be stabilized and thus a good image can be obtained.

Second Embodiment

Next, a second embodiment of the present invention will be described. In this embodiment, a portion different from the first embodiment described above will be specifically described. As regards other portion, unless otherwise specified, constituent elements are the same as those in the first embodiment, and are represented by the same reference numerals or symbols and will be appropriately omitted from description.

In this embodiment, compared with the first embodiment, the apparatus main assembly A has the same constitution as the constitution of the apparatus main assembly A of the first embodiment, and the constitution of a cartridge J is partially different from the constitution of the cartridge B of the first embodiment.

FIG. 11 is an enlarged sectional front view of the cartridge J according to the second embodiment of the present invention. Parts (a) and (b) of FIG. 12 are exploded perspective views of the cartridge J, in which part (a) is the perspective view of the cartridge J as seen from a driving side, and part (b) is the perspective view of the cartridge J as seen from a non-driving side. FIG. 13 is a sectional front view of a principal part of the cartridge J in a state in which the cartridge J is mounted in the apparatus main assembly A. As shown in FIG. 11, the cartridge J includes a cleaning unit 160 and a developing unit 120 constituting the developing device.

The cleaning unit 160 as an image bearing member includes a drum 162, a charging roller 166, a cleaning member 177, and a cleaning frame 171 supporting these members. In the cleaning unit 160, each of the charging roller 166 and the cleaning member 177 is disposed in contact with the outer peripheral surface of the photosensitive drum 162.

The cleaning member 177 includes a rubber blade 177*a* which is a blade-shaped elastic member formed with a rubber as an elastic member, and a supporting member 177*b* for supporting the rubber blade 177*a*. The rubber blade 177*a* counterdirectionally contacts the drum 162 with respect to a rotational direction of the drum 162. That is, the rubber blade 177*a* contacts the drum 162 so that a free end portion thereof extends toward an upstream side with respect to the rotational direction of the drum 162.

Residual (waste) toner removed from the surface of the drum 162 by the cleaning member 177 is stored in a residual (waste) toner chamber 171*b* formed by the cleaning frame 171 and the cleaning member 177.

Further, a sheet member 165 for preventing leakage-out of the residual toner from the cleaning frame 171 is provided on an edge portion of the cleaning frame 171 so as to contact the drum 162.

The drum 162 is rotationally driven in the arrow R direction depending on an image forming apparatus by receiving a driving force from a main assembly driving motor (not shown) which is a driving source.

The charging roller 166 is rotatably mounted in the cleaning unit 160 via charging roller bearings (not shown) at opposite end portions with respect to a longitudinal direction (substantially parallel to a rotational axis direction of the drum 162) of the cleaning frame 171. The charging roller 166 is press-contacted to the drum 162 by being urged at the charging member bearings 167 against the drum 162 by an urging member 168. The charging roller 166 is rotated by rotation of the drum 162.

The developing unit 120 includes a toner chamber 129 as a developer supplying chamber constituted by a developing container 123 and a cap member 122 and includes a toner supplying chamber 28 as a developing chamber. During image formation, a lowermost portion 129*a* of the toner chamber 129 is disposed at a position below a lowermost portion 128*a* of the toner supplying chamber 128 with respect to the direction of gravitation, and the toner chamber 129 and the toner supplying chamber 128 are partitioned by a partition wall 123*m* which is a part of the process cartridge 123.

In the toner chamber 129, toner T is accommodated, and the feeding member 143 for not only stirring the toner T accommodated in the toner chamber 129 but also feeding the toner T toward the toner supplying chamber 128 is provided. The feeding member 143 is constituted by a feeding sheet 143*a* and a feeding member rotation shaft 143*b*.

At a side surface of the toner chamber 129, the partition wall 123*m* is provided with an opening 123*a* communicating the toner chamber 129 and the toner supplying chamber 128 for supplying the toner T toward the toner supplying chamber 128. In the toner supplying chamber 128, a developing roller 132 as a developer carrying member opposing the drum 162 and a developer supply roller 147 as a developer supplying member rotatable in contact with the developing roller 132 are provided.

The developing roller 132 is constituted by a core metal portion 132*a* and a rubber roller portion 132*b*. The core metal portion 132*a* penetrates through the rubber roller portion 132*b* in a rotational axis direction of the developing roller 132, and both end portions thereof from projections 132*a*1 and 132*a*2 projecting from the rubber roller portion 132*b* as shown in FIG. 12.

Further, the developer supply roller 147 is, as shown in FIG. 11, constituted by a core metal portion 147*a* and a sponge roller portion 147*b*. The core metal portion 147*a* penetrates through the sponge roller portion 147*b* in a rotational axis direction of the developer supply roller 147, and both end portions thereof from projections 147*a*1 and 147*a*2 projecting from the sponge roller portion 147*b* as shown in FIG. 12.

The developing roller 132 and the developer supply roller 147 are supported by bearing portions 127*a* and 127*b*, respectively, of a bearing member 127 provided on one end side thereof with respect to axial directions thereof. Similarly, these rollers 132 and 147 are supported by bearing portions 137*a* and 137*b*, respectively, of a bearing member 137 provided on the other end side thereof with respect to axial directions thereof.

As a result, the developing roller 132 is rotatably mounted to the developing container 123.

In the developing unit 120, as shown in FIG. 11, a developing blade 142 for regulating a toner layer on the developing roller 132 is disposed.

At opposite end portions of the developing roller 132 with respect to the axial direction, as shown in FIG. 12, gap retaining members 138 are mounted, and by contact of the gap retaining members 138 with the drum 162, the developing roller 132 is held with a predetermined penetration amount thereof into the drum 162.

Further, as shown in FIG. 11, a sheet member 133 for preventing leakage of the toner from the developing unit 120 is provided at an edge portion of the developing roller 132 so as to contact the developing roller 132.

The developing container 123 of the developing unit 120 is provided with a first developing (device) supporting boss 123*a* and a second developing (device) supporting boss 123*b* which are used as portions-to-be-supported provided on a toner chamber 129 on a side different from a developing roller 132 side with respect to a surface where the partition wall 123*m* is disposed.

Further, as shown in FIG. 12, the developing unit 120 is connected to the cleaning unit 160 by supporting the first developing supporting boss 123*a* and the second developing supporting boss 123*b* by a first hanging hole (not shown) and a second hanging hole 171*j*, respectively.

In a state in which the cartridge J is positioned in the apparatus main assembly A, as shown in FIG. 13, at a lower portion of the toner supplying chamber 128 and below the developing roller 132 with respect to the direction of gravitation, a recessed portion 200 formed by depressing an outer configuration portion of the process cartridge 123 toward an inside of the toner supplying chamber 128 is provided. The recessed portion 200 is disposed at a position remoter from the drum 162 than from the developing roller 32 as seen from the drum 162.

The recessed portion 200 is constituted by a lower portion 123*m*1 of the partition wall 123*m*, a first surface 123*p* forming the opening 123*n* provided in the partition wall 123*m*, and a second surface 123*r* as a contact surface which is a side surface of the recessed portion 200 recessed toward the inside of the toner supplying chamber 128. In a cross-section perpendicular to an axial direction of the rotation shaft of the developing roller 132, the second surface 123*r* includes a surface at least partially overlapping with the developing roller 132 as seen in an arrow H direction perpendicular to a rectilinear line connecting a rotation center of the developing roller 132 and a swing center of the first developing supporting boss 123*a* and the second developing supporting boss 123*b*.

The drive transmission from the apparatus main assembly A to the cartridge J is similar to the drive transmission in the first embodiment, and the apparatus main assembly A is provided with the driving portion 14 (FIG. 8) for transmitting drive (driving portion) to an engaging portion 170 provided to the cartridge J. The driving portion 14 is driven by a motor (not shown) of the apparatus main assembly A. As shown in FIG. 12, the drum 162 connected to the engaging portion 170 is rotated by receiving a driving force from the apparatus main assembly A.

Further, the driving force is transmitted from drum gear 163*a* provided on the driving side drum flange 163 to a developing roller gear 130, so that the developing roller 132 is rotated. The driving force is transmitted from the developing roller gear 130 to a developer supply roller 148 via an idler gear 140, so that the developer supply roller 147 shown in FIG. 11 is rotated. Further, the driving force is transmitted from the developing roller gear 130 to a feeding gear 139 via idler gears 140 and 141, so that the feeding member 143 is rotated. The charging roller 166, the developing roller 132 and the developer supply roller 147 are energized by an energizing portion (not shown) of the apparatus main assembly A.

Driving force transmission from the apparatus main assembly A to the cartridge J is not limited to this form, but may also be form such that drive is transmitted from the apparatus main assembly to each of the drum and the developing roller.

The driving side restricting member 101 and the non-driving side restricting member 102 which are restricting members are configured so that when the cartridge J is inserted into the apparatus main assembly A, as shown in FIG. 13, these members can enter the recessed portion 200 provided at a lower surface of the developing container 123. In a state in which the cartridge J is positioned relative to the apparatus main assembly A, the movement restricting portion 101*a* and the movement restricting portion 102*a* oppose the second surface 123*r*.

Further, a gap n is provided between the movement restricting portion 101*a* and the second surface 123*r*. Similarly, a gap o is provided between the movement restricting portion 102*a* and the second surface 123*r*. The gaps n and o are determined in consideration of variations in component part dimension, or the like, and in the state in which the cartridge J is mounted in the apparatus main assembly A, the gaps are set so as to be always certain gaps. Therefore, in the state in which the cartridge J is mounted in the apparatus main assembly A, the driving side restricting member 101 and the non-driving side restricting member 102 do not contact a constituent component part (for example, the developing container 123) constituting the cartridge J.

Similarly as in the first embodiment, the developing unit 120 is connected to the cleaning unit 160 swingably about the first and second developing supporting bosses 123*a* and 123*b* of the developing container 123 as a swing center. Further, by the driving side urging member 146L and the non-driving side urging member 146R which are urging members constituting the developing device, the device 120 is urged about the first and second developing supporting bosses 123*a* and 123*b* against the cleaning unit 160. As a result, the developing roller 132 is pressed toward a direction of the drum 162. Then, the developing roller 132 is held with a predetermined penetration amount into the drum 162 by the gap retaining members 138 shown in FIG. 12.

Therefore, the developing unit 120 is positioned only relative to the cleaning unit 160, so that a good image can be obtained without obstructing setting of the developing unit 120 during image formation.

In recent years, a type of packing including the cartridge in the main assembly during shipping such that the cartridge J is included in the apparatus main assembly A during shipping of the apparatus main assembly A has been taken so that a user can use the apparatus main assembly A immediately after purchase. In this type of packing including the cartridge in the main assembly, after shipping from a factory, these is a possibility that vibration and impact due to transportation are exerted on the cartridge J included in the apparatus main assembly A.

As described above, the developing unit 120 is connected to the cleaning unit 160 swingably about the first and second developing supporting bosses 123*a* and 123*b* of the developing container 123 the swing center. Further, the driving side urging member 146L and the non-driving side urging member 146R swing and urge the developing unit 120 toward the cleaning unit 160 about the first and second developing supporting bosses 123*a* and 123*b* of the developing container 123 as the swing center. As a result, the developing roller 132 is pressed toward the drum 162.

On the other hand, the vibration and the impact due to transportation are exerted on the cartridge J packed in the apparatus main assembly A, so that the developing unit 120 is liable to be swung, in a second direction opposite to a first direction which is an urging direction, against an urging force toward the cleaning unit 160 in some cases. That is, in some cases, the developing unit 120 is liable to swing in the second direction opposite to the first direction (urging direction) in a distance which is not less than each of the gaps (n and o) between the movement restricting portion (101*a* and 102*a*) and the second surface 123*r*.

In such a case, the second surface 123*r* positioned downstream of the movement restricting portions 101*a* and 102*a* with respect to the first direction is contactable to the movement restricting portions 101*a* and 102*a* and restricts swing of the developing unit 120. As a result, by the driving side urging member 146L and the non-driving side urging member 146R, a force of collision of the developing unit 120 with the cleaning unit 160 due to swing back can be suppressed to a certain level. As a result, it is possible to prevent breakage or the like of component parts.

Incidentally, as described above, the recessed portion 200 is formed by depressing the outer configuration portion of the developing container 123, positioned below the developing roller 32 with respect to the direction of gravitation, toward the inside of the toner supplying chamber 128.

Further, by providing the second surface 123*r* in the neighborhood of a place where of the component parts used for the developing unit 120, component parts (the developing roller 132, the developing blade 142, the developer supply roller 147) which are high in weight ratio are disposed, it is possible to dispose the second surface 123*r* without excessively increasing rigidity of the frame.

The movement restricting portions 101*a* and 102*a* are caused to oppose the second surface 123*r* on both end portion sides of the developing container 123. As a result, the second surface 123*r* can contact the movement restricting portions 101*a* and 102*a* at high rigidity portions of the frame close to the bearings 127 and 137 provided at end portions of the developing container 123, so that a vibration absorbing performance and an impact absorbing performance during transportation can be efficiently enhanced.

Further, the recessed portion 200 is provided at the lower surface of the developing container 123, whereby the rigidity of the frame in the neighborhood of the toner supplying chamber 128 can be enhanced, so that entire strength of the developing unit 120 is increased. As a result, when the developing unit 120 is urged toward the cleaning unit 160, deformation of the developing unit 120 is suppressed, so that a force for pressing the developing roller 132 toward the drum 162 can be stabilized and thus a good image can be obtained.

In the above-described embodiments, the driving side restricting member 101 and the non-driving side restricting member 102 are provided in the apparatus main assembly A, but may also be provided on the cleaning (drum) unit 60 of the cartridge B(J).

In the above-described embodiments, the driving side urging members 46L and 146L and the non-driving side urging members 46R and 146R are provided in the cartridge B(J), but may also be provided in the apparatus main assembly A.

Further, as the image forming apparatus of the electrophotographic type, an electrophotographic copying machine, an electrophotographic printer (LED printer, laser beam printer or the like), a facsimile machine, a word processor, and the like are included.

Further, the present invention is also applicable to, in addition to the above-described process cartridge including the drum unit and the developing unit, a developing cartridge consisting only the developing unit and a process cartridge constituted so that a toner accommodating portion is mountable in and dismountable from the process cartridge. Further, the present invention is also applicable to a constitution in which the developing unit is integrally assembled with the image forming apparatus main assembly. Further, in these constitutions, an effect similar to the effect of the above-described process cartridge can be achieved.

Further, the present invention is also applicable to a cartridge employing a so-called cleaner-less system in which a cleaning member is not provided, or the like system.

(Summary of Structures of the Present Invention)

The present invention also includes technical features as shown below.

According to another aspect of the present invention, there is provide a developing device comprising: a developing unit comprising, a developing frame, a developer carrying member rotatably supported by the developing frame, a first shaft portion provided at one end of the developing frame with respect to a longitudinal direction of the developing frame, and a second shaft portion provided at the other end of the developing frame with respect to the longitudinal direction and disposed coaxially with the first shaft portion, wherein the developing unit is swingably about an axis of the first and second shaft portions as a swing axis, wherein the developing frame includes a projection formed by depressing a part of an outer surface thereof so as to project toward an inside of the developing frame, wherein in a cross section perpendicular to an axial direction of a rotation shaft of the developer carrying member, as seen in a direction perpendicular to a rectilinear line connecting the swing axis of the developing unit and an axis of rotation of the developer carrying member, the developer carrying member and of the projection are disposed so as to overlap with each other.

The developing device may be configured such that, the developing frame includes a developing chamber in which the developer carrying member is disposed, a developer supplying chamber configured to supply the developer to the developing chamber, and an opening configured to communicate the developing chamber and the developer supplying chamber, wherein the projection is formed on the developing chamber.

The developing device may be configured such that, in an attitude during use, the projection is positioned below the developer carrying member with respect to a direction of gravitation.

The developing device may be configured such that, the developing device is mountable in and dismountable from an image forming apparatus, wherein the image forming apparatus includes a restricting portion configured to restrict movement of the developing device relative to the image forming apparatus, and wherein when the developing device is mounted in the image forming apparatus, the restricting portion enters the projection.

The developing device may be configured such that, the projection is provided on each of opposite end portions of the developing frame with respect to the longitudinal direction.

According to another aspect of the present invention, there is provide a process cartridge comprising: the developing device; and an image bearing member configured to bear a developer image, wherein the process cartridge is mountable in and dismountable from an image forming apparatus.

The process cartridge may be configured such that, as seen along the axial direction of the rotation shaft of the developer carrying member, the projection is disposed at a position spaced from the image bearing member than the developer carrying member is.

According to another aspect of the present invention, there is provide an image forming apparatus comprising: the process cartridge; an opening including a cartridge inserting opening configured to permit mounting of the process cartridge; and an openable member configured to open and close the opening.

According to another aspect of the present invention, there is provide a developing device comprising: a developing member configured to develop an image on an image bearing member with a developer; a frame containing the developing member; wherein the frame is provided with a recessed portion configured to permit movement of the developing device in a direction in which the developing member approaches to the image bearing member, a part of the frame defining the recessed portion is configured to abut to a restricting member when the developing device moves in a direction away from the image bearing member.

According to another aspect of the present invention, there is provide a developing device usable with an image forming unit including an image bearing member and a restricting member, the developing device comprising: a developing member configured to develop an image on the image bearing member with a developer; a frame containing the developing member; wherein the frame is provided with a recessed portion configured to permit movement of the developing device in a direction in which the developing member approaches to the image bearing member, a part of the frame defining the recessed portion is configured to abut to the restricting member when the developing device moves in a direction away from the image bearing member.

The developing device may be configured such that, the image forming unit is a drum unit including the image bearing member.

The developing device may be configured such that, the image forming unit is a main assembly of an image forming apparatus.

According to the present invention, it is possible to provide the developing device, the process cartridge and the image forming apparatus which are capable of suppressing the impact due to the movement of the developing unit during the transportation without upsizing the developing unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-239940 filed on Dec. 21, 2018, which is hereby incorporated by reference herein in its entirety.

What is claimed is:

1. A developing device comprising:

a developing unit having a developing chamber configured to provide a developer to an image bearing member and a developer supplying chamber configured to supply the developer to said developing chamber, with the developing unit swingably supported and configured to supply the developer to the image bearing member and including an inwardly extending wall portion formed on said developing chamber; and an urging member configured to urge said developing unit in a first direction toward the image bearing member by an urging force, wherein when said developing unit is moved in a second direction opposite to the first direction against the urging force, said inwardly extending wall portion is contactable to a restricting member configured to restrict an amount of movement of said developing unit in the second direction.

2. A developing device according to claim 1, wherein said inwardly extending wall portion is formed as a part of a recessed portion provided on said developing unit.

3. A developing device according to claim 2, wherein said recessed portion is capable of receiving the restricting portion, and wherein said inwardly extending wall portion is formed by a side surface of the recessed portion positioned on a side downstream of said restricting member with respect to the first direction.

4. A developing device according to claim 1, wherein said inwardly extending wall portion is formed as a part of a recessed portion formed by depressing an outer configuration portion of said developing chamber toward an inside of said developing chamber.

5. A developing device according to claim 4, wherein said recessed portion is capable of receiving the restricting member, and wherein said inwardly extending wall portion is formed by a side surface of said recessed portion positioned on a side downstream of the restricting member with respect to the first direction.

6. A developing device according to claim 4, wherein said developing unit includes a partition wall configured to partition said developing chamber and said developer supplying chamber and provided with an opening for permitting communication between said developer supplying chamber and said developing chamber so as to supply the developer from said developer supplying chamber to said developing chamber.

7. A developing device according to claim 1, wherein said developing unit rotatably supports a developer carrying member configured to provide the developer to the image bearing member.

8. A developing device according to claim 7, wherein in a cross-section perpendicular to an axial direction of a rotation shaft of said developer carrying member, as seen in a direction perpendicular to a rectilinear line connecting a center of swing of said developing unit and a center of rotation of said developer carrying member, said developer carrying member and at least a part of said inwardly extending wall portion overlap with each other.

9. A developing device according to claim 7, wherein the restricting member is provided at a position corresponding to each of opposite end portion sides of said developing unit with respect to a rotational axis direction of said developer carrying member.

10. A developing device according to claim 7, wherein said developing unit rotatably supports developer supply roller configured to supply the developer to the image bearing member.

11. A developing device according to claim 1, wherein said developer supplying chamber includes a portion-to-be-supported where said developing unit is swingably supported.

12. A developing device according to claim 10, wherein the restricting member is provided in an image forming apparatus in which said developing device is to be mounted.

13. A developing device according to claim 1, wherein the image bearing member includes a photosensitive member, and the developer contains toner.

14. A process cartridge comprising:

a developing device according to claim 1; and an image bearing member configured to bear a developer image.

15. A process cartridge according to claim 14, which is mountable in and dismountable from an image forming apparatus.

16. An image forming apparatus comprising:

a process cartridge according to claim 14;

an opening including a cartridge inserting opening configured to permit mounting of said process cartridge; and an openable member configured to open and close said opening.

17. An image forming apparatus comprising:

a developing device according to claim 1; and an image bearing member configured to bear a developer image.

18. A developing device comprising:

a developing unit comprising, a developing frame forming a developing chamber and a developer supplying chamber, a developer carrying member disposed in said developing chamber and rotatably supported by said developing frame, a first shaft portion provided at one end of said developing frame with respect to a longitudinal direction of said developing frame, and a second shaft portion provided at the other end of said developing frame with respect to the longitudinal direction and disposed coaxially with said first shaft portion, and a supporting member for swingably supporting said developing unit, wherein said developing unit is swingably supported about an axis of said first and second shaft portions as a swing axis when said developing unit is supported by said supporting member, wherein said developing frame includes a projection formed by depressing a part of an outer surface thereof so as to project toward an inside of said developing chamber of said developing frame, wherein in a cross-section perpendicular to an axial direction of a rotation shaft of said developer carrying member, as seen in a direction perpendicular to a rectilinear line connecting the swing axis of said developing unit and an axis of rotation of said developer carrying member, said developer carrying member and said projection are disposed so as to overlap with each other.

19. A developing device according to claim 18, wherein in a position of the developing device during use with an image forming apparatus, said projection is positioned below said developer carrying member with respect to a direction of gravitation.

20. A developing device according to claim 18, wherein said developing device is mountable in and dismountable from an image forming apparatus, wherein the image forming apparatus includes a restricting portion configured to restrict movement of said developing device relative to the image forming apparatus, and wherein when said developing device is mounted in the image forming apparatus, the restricting portion enters said projection.

21. A developing device according to claim 18, wherein said projection is provided on each of opposite end portions of said developing frame with respect to the longitudinal direction.

22. A process cartridge comprising:

a developing device according to claim 18; and an image bearing member configured to bear a developer image, wherein said process cartridge is mountable in and dismountable from an image forming apparatus.

23. A process cartridge according to claim 22, wherein, in a case that the process cartridge is used with an image forming apparatus, and as seen along the axial direction of the rotation shaft of said developer carrying member, said projection is disposed at a position spaced farther from said image bearing member than said developer carrying member.

24. An image forming apparatus comprising:

a process cartridge according to claim 22;

an opening including a cartridge inserting opening configured to permit mounting of said process cartridge; and an openable member configured to open and close said opening.

25. A developing device comprising:

a developing member configured to develop an image on an image bearing member with a developer;

a frame forming a developer supplying chamber and a developing chamber in which said developing member is contained;

wherein said frame is provided with a recessed portion formed on said developing chamber and configured to permit movement of said developing device in a direction in which said developing member approaches the image bearing member, and a part of said frame defining said recessed portion is configured to abut a restricting member when said developing device moves in a direction away from the image bearing member.

26. A developing device usable with an image forming unit including an image bearing member and a restricting member, said developing device comprising:

a developing member configured to develop an image on the image bearing member with a developer;

a frame forming a developing supplying chamber and a developing chamber in which said developing member is contained;

wherein said frame is provided with a recessed portion formed on said developing chamber and configured to permit movement of said developing device in a direction in which said developing member approaches the image bearing member, and a part of said developing chamber of said frame defining said recessed portion is configured to abut to the restricting member when said developing device moves in a direction away from the image bearing member.

27. A developing device according to claim 26, wherein the image forming unit is a drum unit including the image bearing member.

28. A developing device according to claim 26, wherein the image forming unit is a main assembly of an image forming apparatus.

* * * * *